US007052578B2

(12) United States Patent
Wajer et al.

(10) Patent No.: US 7,052,578 B2
(45) Date of Patent: May 30, 2006

(54) PROCESS EMPLOYING MAGNESIUM HYDROXIDE IN PEROXIDE BLEACHING OF MECHANICAL PULP

(75) Inventors: Mark T. Wajer, Nottingham, MD (US); Aileen R. Gibson, Owings Mills, MD (US); Joseph Genco, Orono, ME (US); Donna Johnson, Orono, ME (US); Burton Branch, Fredericton, NB (CA)

(73) Assignee: Martin Marietta Magnesia Specialties, Inc., Raleigh, NC (US)

( * ) Notice: Subject to any disclaimer, the term of this patent is extended or adjusted under 35 U.S.C. 154(b) by 21 days.

(21) Appl. No.: 09/769,761

(22) Filed: Jan. 26, 2001

(65) Prior Publication Data

US 2001/0050153 A1 Dec. 13, 2001

Related U.S. Application Data

(60) Provisional application No. 60/207,205, filed on May 26, 2000, provisional application No. 60/178,704, filed on Jan. 28, 2000.

(51) Int. Cl.
*D21C 9/16* (2006.01)

(52) U.S. Cl. ..... 162/24; 162/78; 162/80; 162/90

(58) Field of Classification Search ..... 162/76, 162/78, 90, 25, 24, 26, 28
See application file for complete search history.

(56) References Cited

U.S. PATENT DOCUMENTS

| | | | | |
|---|---|---|---|---|
| 3,193,445 | A * | 7/1965 | Parker et al. | 162/76 |
| 3,251,731 | A * | 5/1966 | Gard | 162/71 |
| 3,694,309 | A | 9/1972 | Glerer et al. | |
| 4,029,543 | A * | 6/1977 | Lindahl | 162/24 |
| 4,132,589 | A | 1/1979 | Christensen | |
| 4,222,819 | A * | 9/1980 | Fossum et al. | 162/76 |
| 4,734,160 | A | 3/1988 | Moldenius | |
| 4,798,652 | A | 1/1989 | Joyce et al. | |
| 4,915,785 | A | 4/1990 | Siminoski et al. | |
| 5,118,389 | A | 6/1992 | Dubelsten et al. | |
| 5,223,091 | A | 6/1993 | Hetzler et al. | |
| 5,310,458 | A | 5/1994 | Lundgren et al. | |
| 6,056,853 | A | 5/2000 | Vincent et al. | |
| 6,632,328 | B1 * | 10/2003 | Wan et al. | 162/78 |

FOREIGN PATENT DOCUMENTS

| | | | | |
|---|---|---|---|---|
| AU | 199941044 | | 7/1999 | |
| CA | 2278399 | | 7/1999 | |
| CA | 2278399 | * | 1/2000 | 162/78 |

(Continued)

OTHER PUBLICATIONS

Tappi Journal, "Mecahncial Pulps", p. 232., Dec.-1987.*

(Continued)

*Primary Examiner*—Steve Alvo
(74) *Attorney, Agent, or Firm*—Marger Johnson & McCollom, PC

(57) ABSTRACT

Wood pulp is bleached using hydrogen peroxide as the oxidative bleaching agent in the presence of magnesium hydroxide or magnesium oxide. The bleaching process is carried out in the presence of magnesium hydroxide as the predominant, and preferably essential, source of alkali. The process optionally includes transition metal chelants, such as DTPA or EDTA in the bleaching slurry. The process eliminates the need for added caustic and silicate in such systems and can be carried out at or near neutral pH of 5.0 to 8.5.

26 Claims, 16 Drawing Sheets

FOREIGN PATENT DOCUMENTS

WO 96/41917 * 12/1996

OTHER PUBLICATIONS

Burton—An Investigation into the Roles of Sodium Silicate and Epsom Salt in Hydrogen Peroxide Bleaching—Journal of Pulp and Paper Science: vol. 12 No. 4, Jul. 1986.
Griffiths et al.—Magnesium oxide as a base for peroxide bleaching of radiata pine TMP—Appita vol. 47, No. 1.
Mahagaonkar et al.—Peroxide bleaching of radiata pine TMP and eucalyptus regnans with caustic soda pulps with sodium hydroxide and magnesium oxide—Mahagaonkar et al. Appita, vol. 48, No. 1, pp. 40-44.
Maughan et al.—Use of Magnesium Oxide as an Alkali For Fefiner Brightening of Pinus Radiata TMP, Appita '92—pp. 123-131.
Abbot et al.—The influence of manganese and magnesium on alkaline peroxide bleaching of radiata pine thermomechanical pulp, Appita vol. 45, No. 2, pp. 109-120.
Smoothing the Way, 1993, Paper (London) 218 (4):30-35.
Abbot et al.—Reagent recycling in peroxide bleaching, 1992 Appita Journal 45(6):393-396.
Seccombe et al.—Soda ash and magnesium oxide—alkali sources for the bleaching of mechanical pulp—Paper Technology, Apr. 1995, p. 29-34.
Brown, et al.—Magnesium as a stabilizer for peroxide bleaching of mechanical pulp—Appita, vol. 47, No. 3.
Vincent, et al.—Magnesium oxide driven peroxide bleaching, an economical and environmentally viable process -.
Arnevik et al.—Peroxide Bleaching of Mechanical Pulps at High Consistency, Norway Pulp and Paper Industries—Chapter 33, pp. 555-570.

* cited by examiner

FIG. 3 Northern TMP # 1
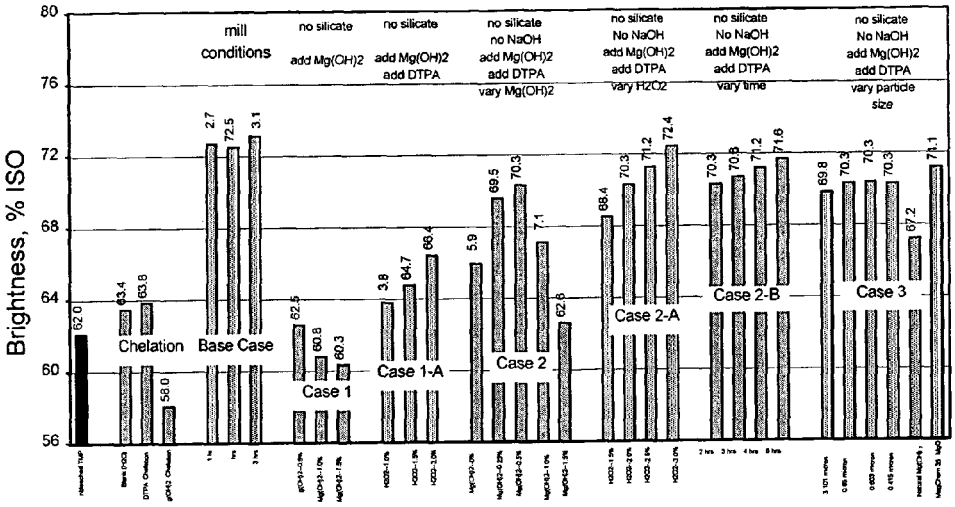
FIG. 4 Northern TMP # 1
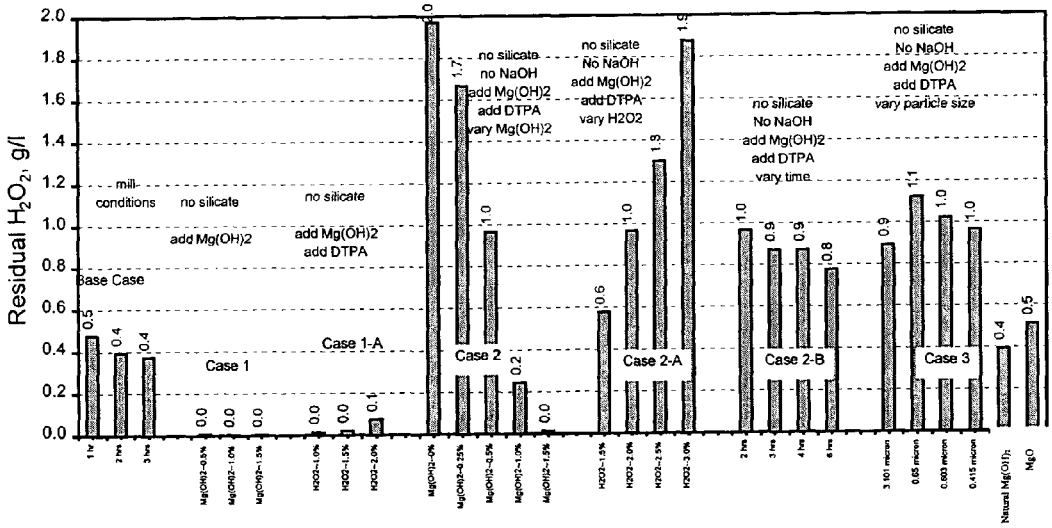

FIG. 5 Northern TMP # 1
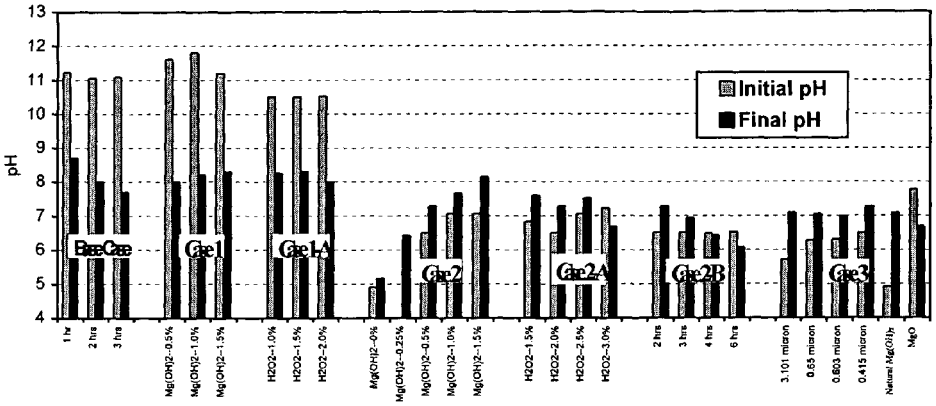
FIG. 6 Northern TMP # 2
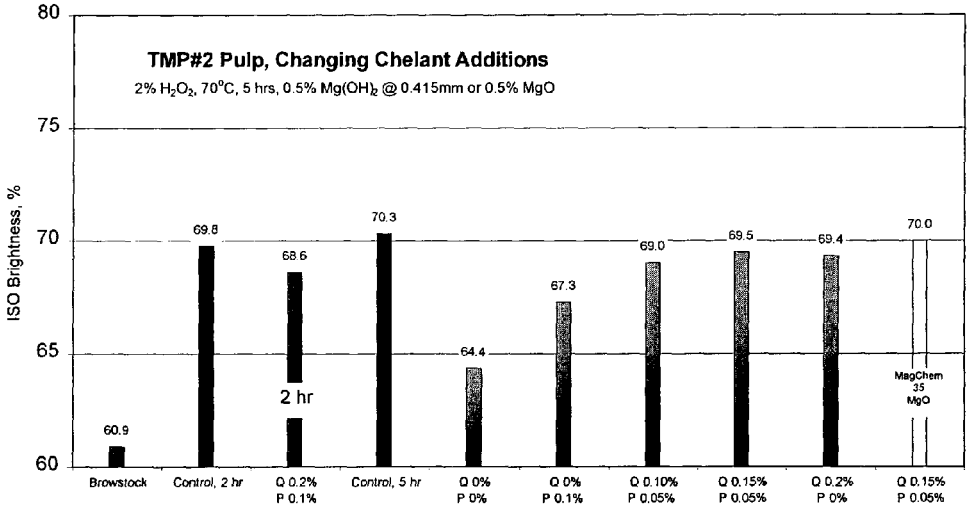
Chelant in Q - Chelation stage, P- peroxide stage FIG. 7 Northern TMP # 2
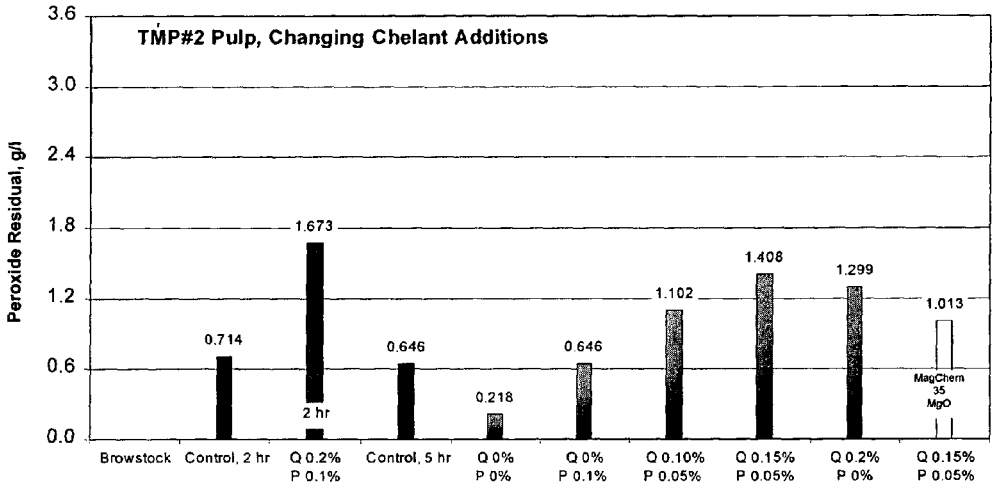
Chelant in Q - Chelation stage, P- peroxide stage
FIG. 8
Northern TMP # 2
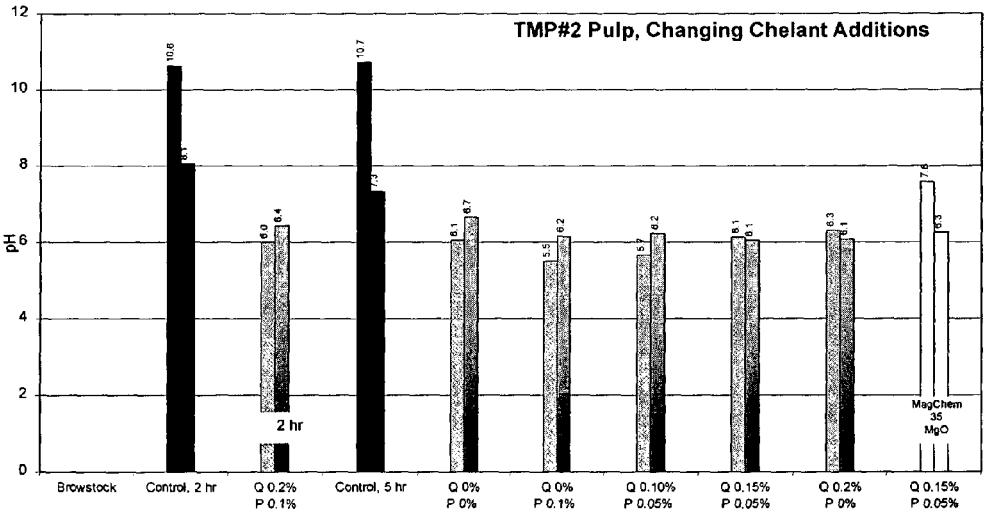
Chelant in Q - Chelation stage, P- peroxide stage FIG. 9 Northern TMP
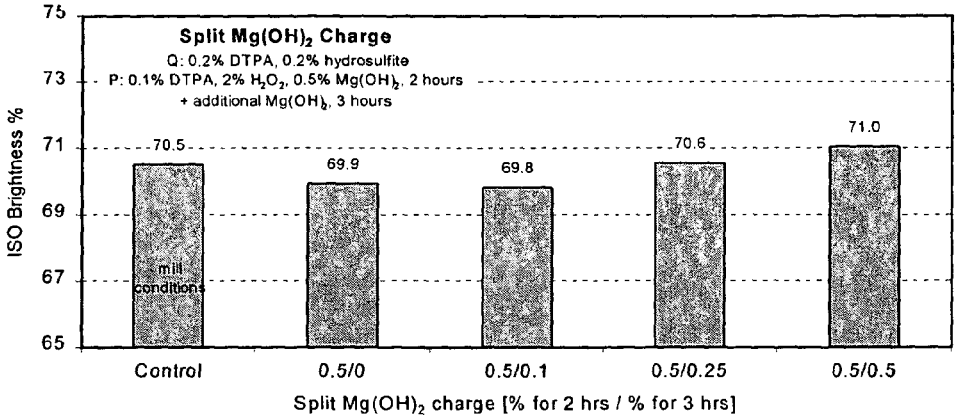
FIG. 10 Northern TMP
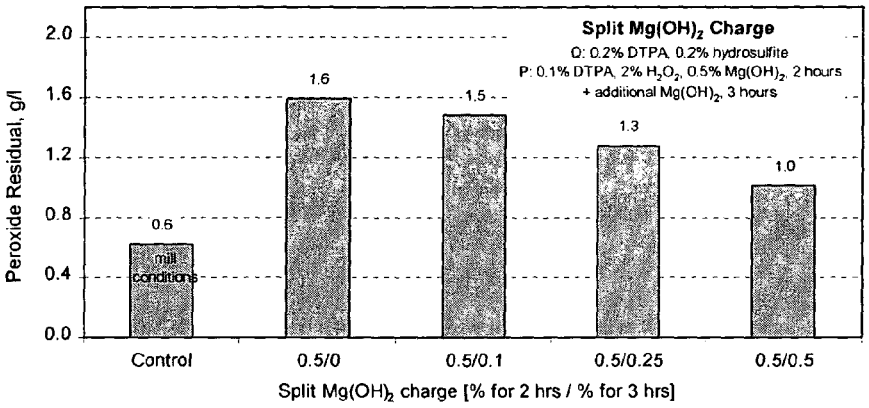
FIG. 11 Northern TMP
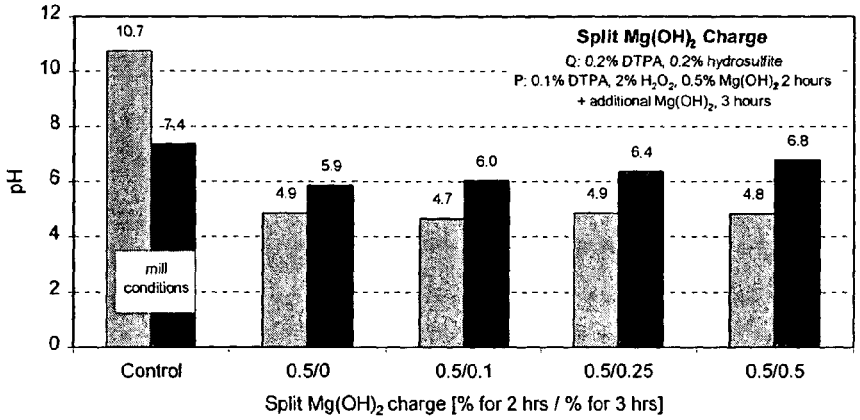

FIG. 12 Northern TMP
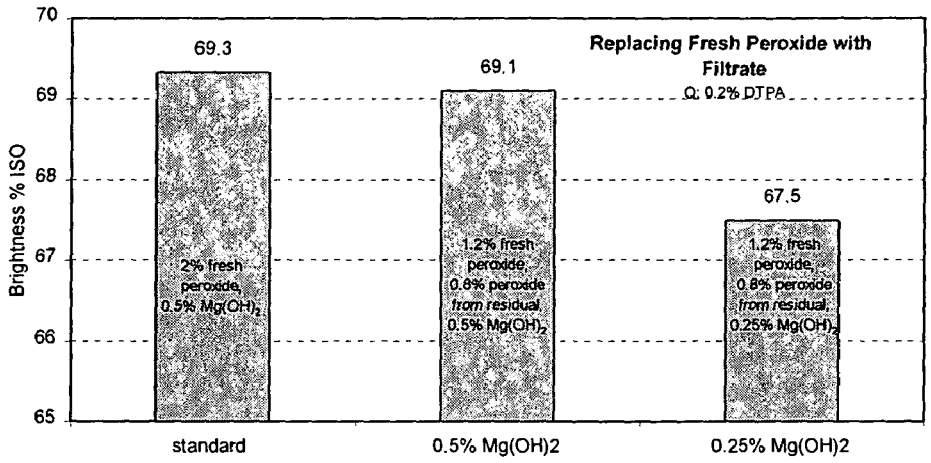
FIG. 13 Northern TMP
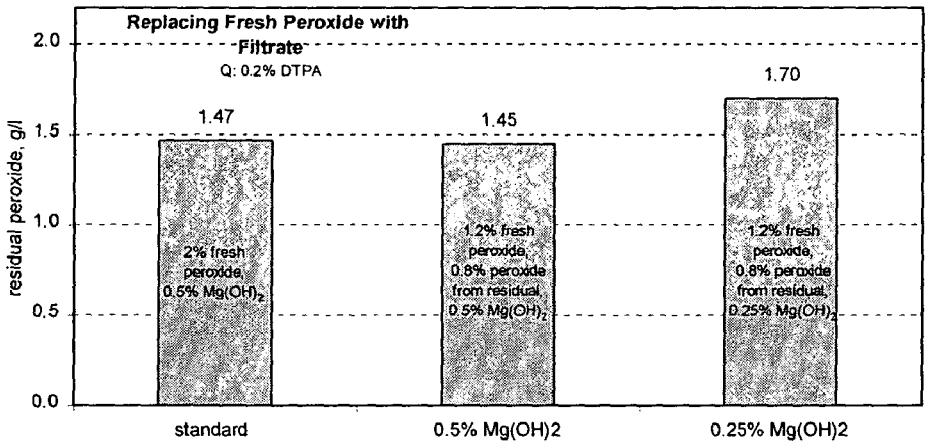
FIG. 14 Northern TMP
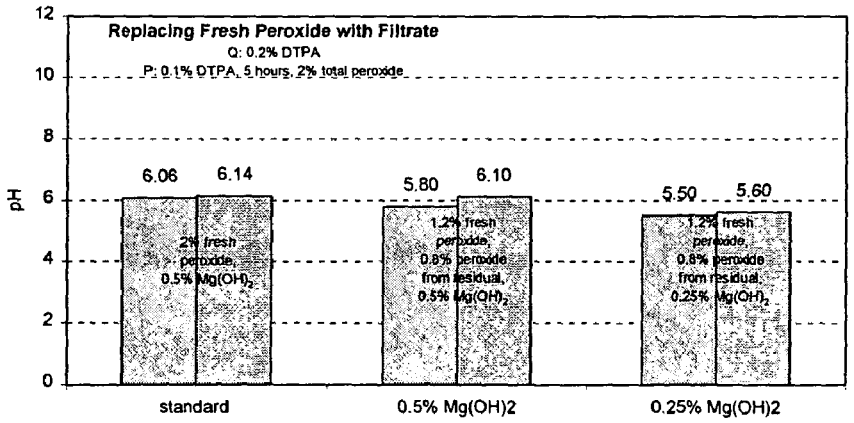

FIG. 15 Northern TMP
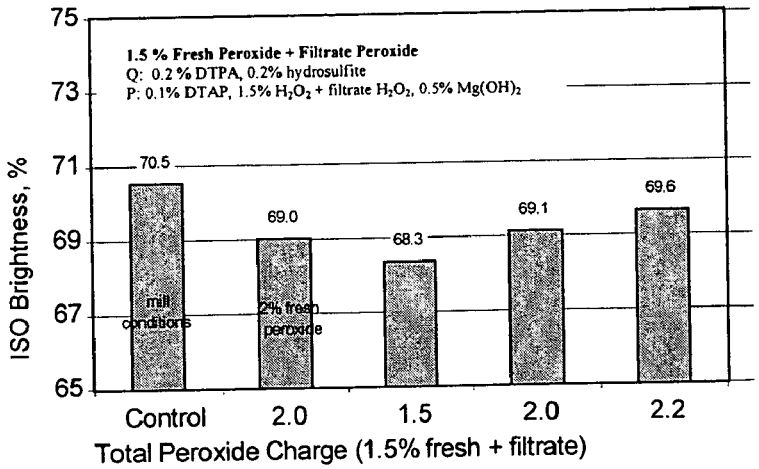
FIG. 16 Northern TMP
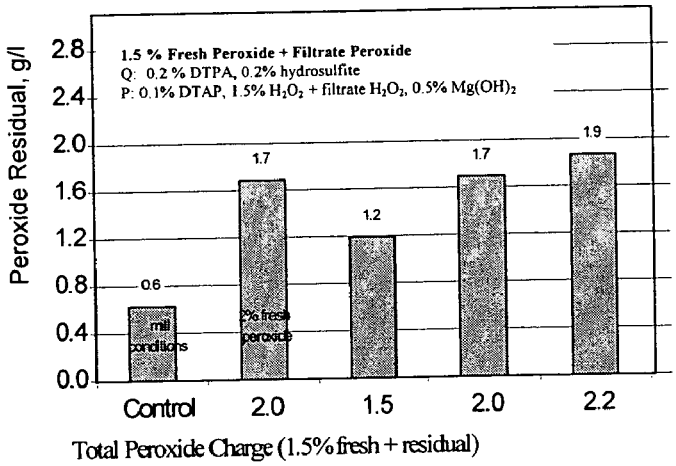
FIG. 17 Northern TMP
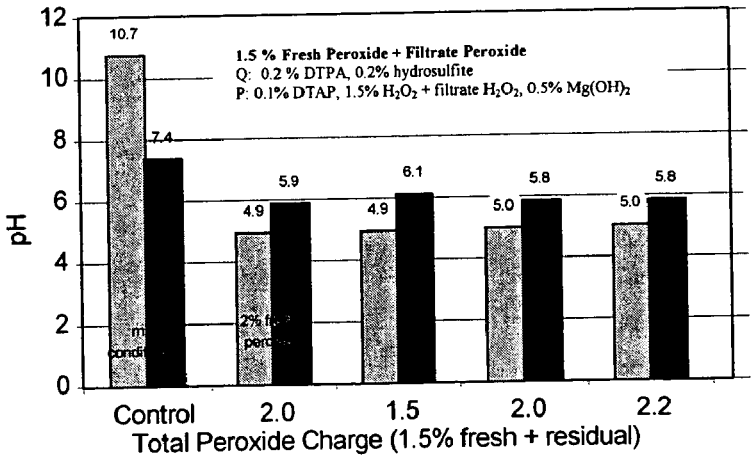

FIG. 18 Northern TMP
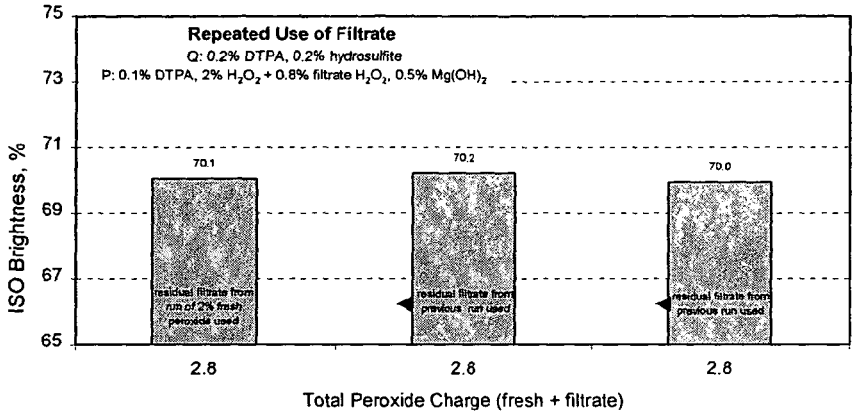
FIG. 19 Northern TMP
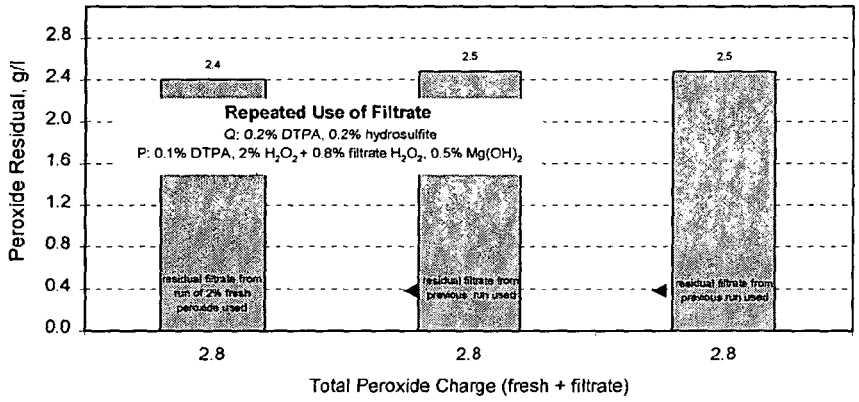
FIG. 20 Northern TMP
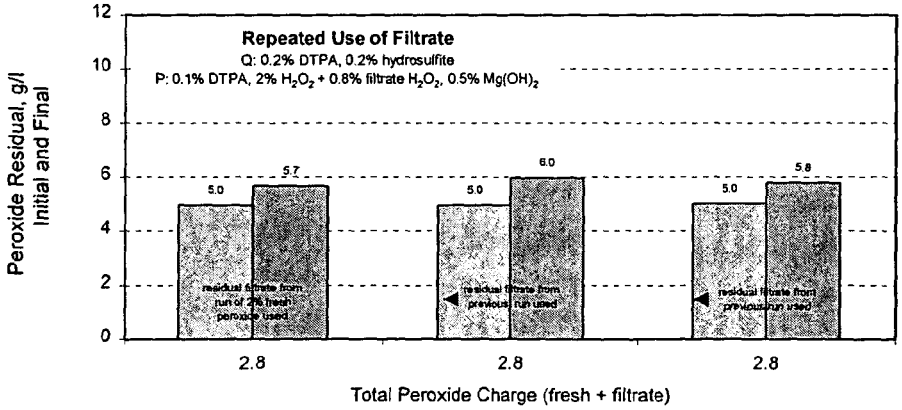

FIG. 21 Northern TMP
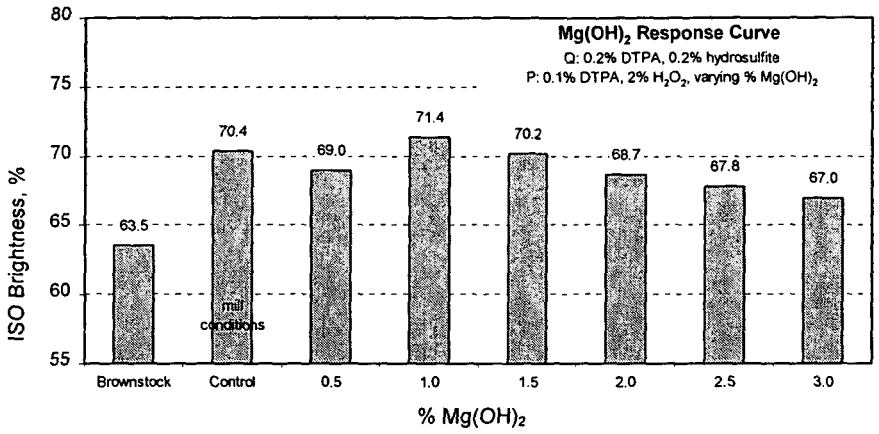
FIG. 22 Northern TMP
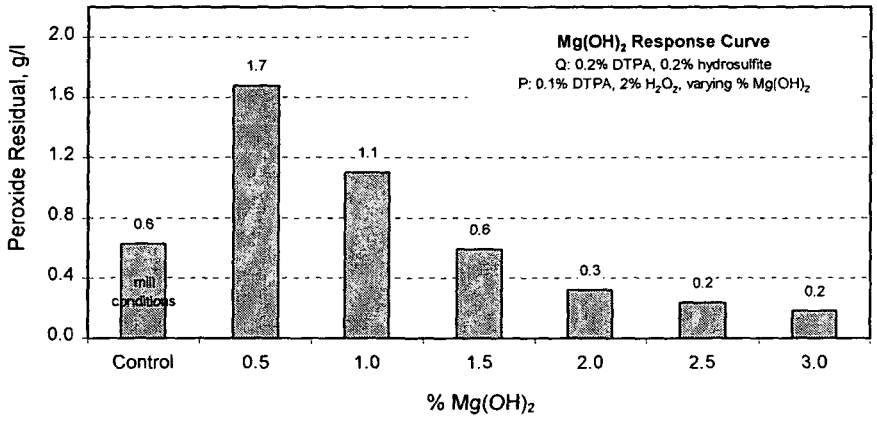
FIG. 23 Northern TMP
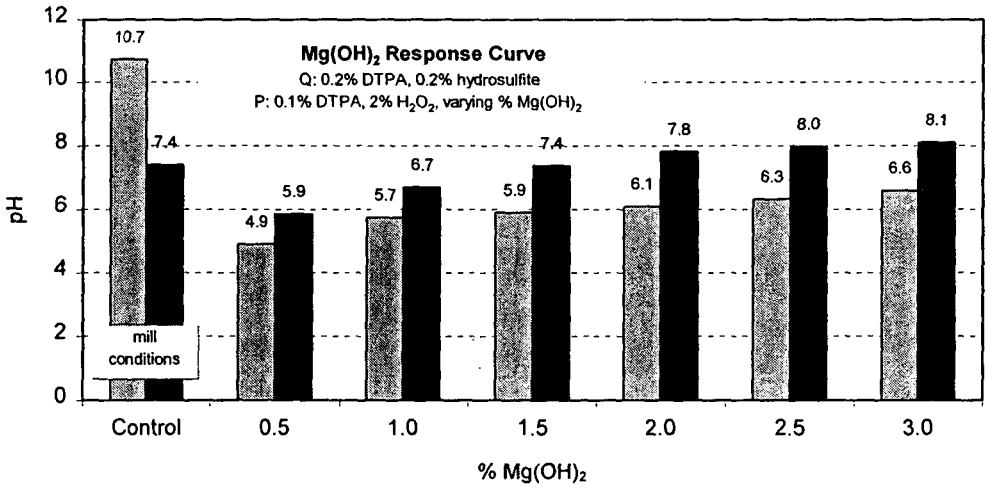

FIG. 24 COD Data
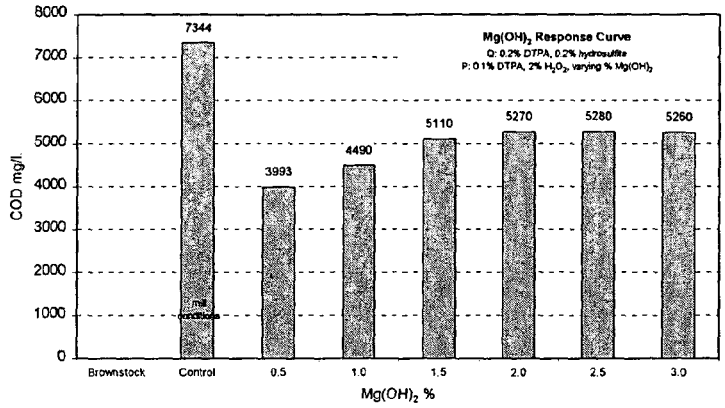
FIG. 25 Northern TMP
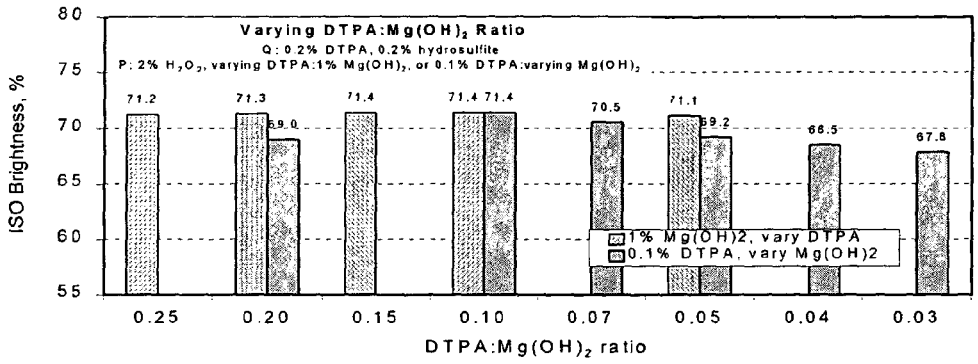
FIG. 26 Northern TMP
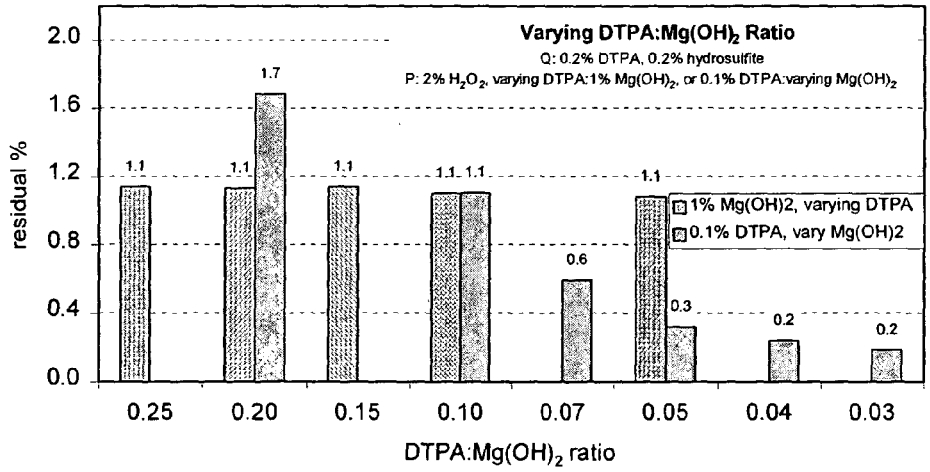

FIG. 27 Northern TMP
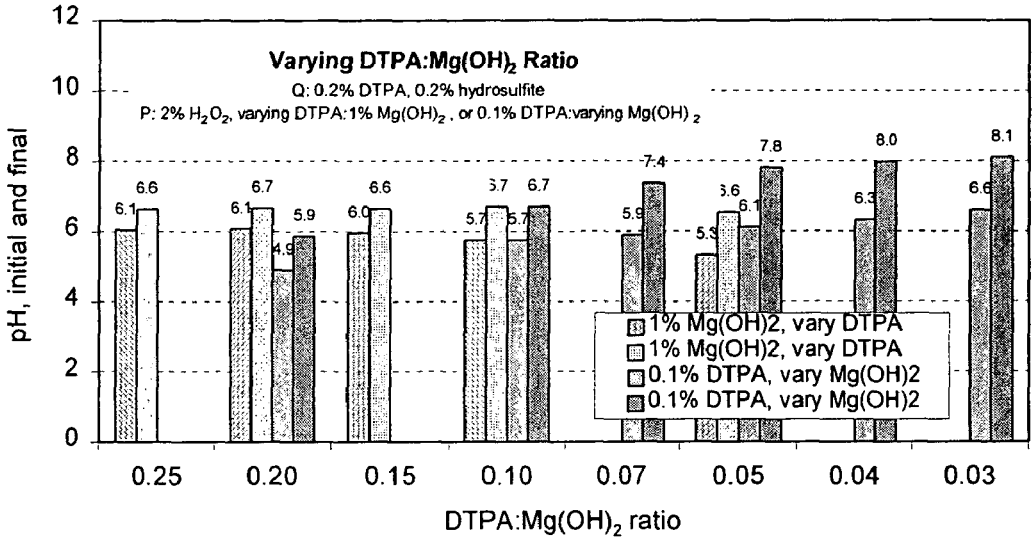
FIG. 28 Northern TMP
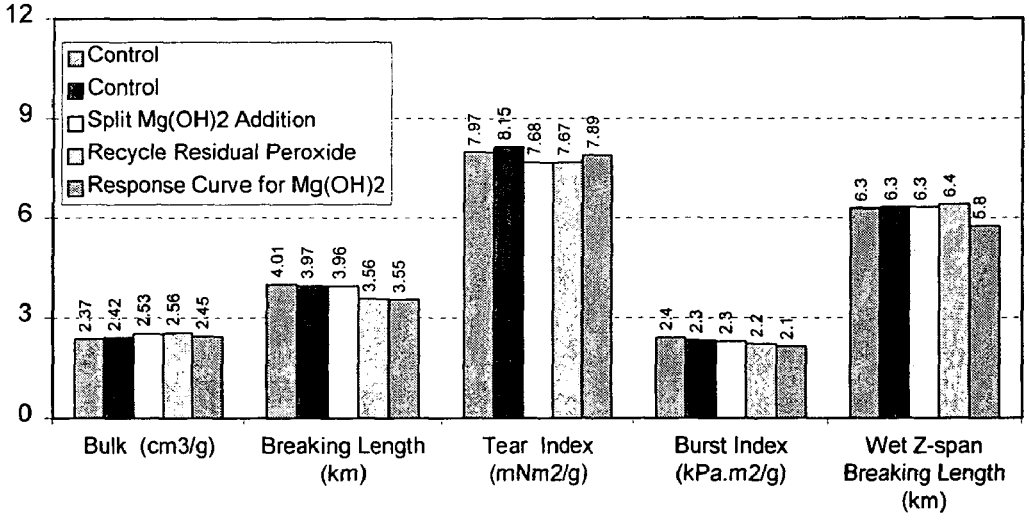

FIG. 29 Northern Groundwood
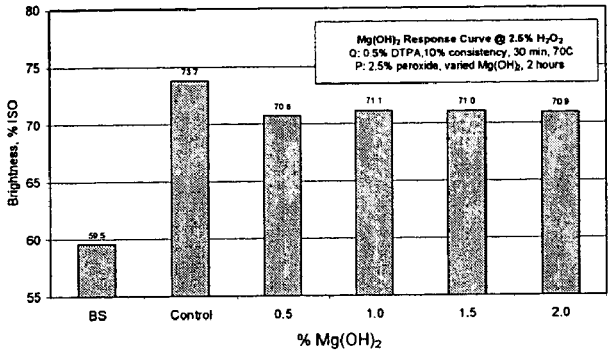
FIG. 30 Northern Groundwood
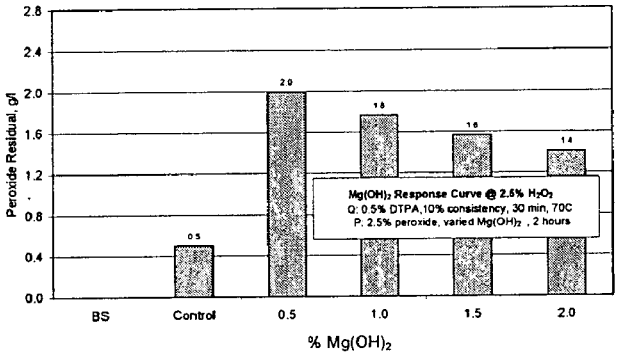
FIG. 31 Northern Groundwood
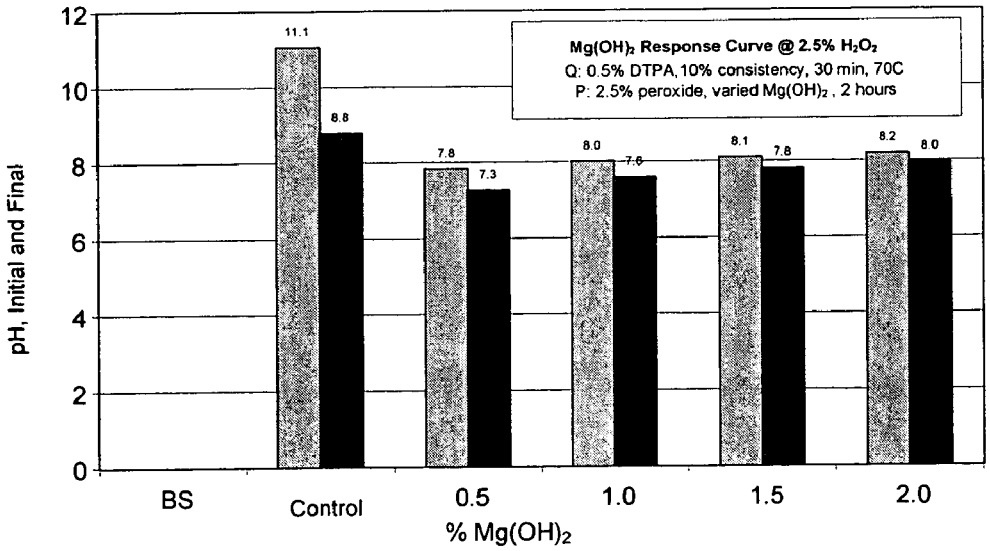

FIG. 32 Northern Groundwood
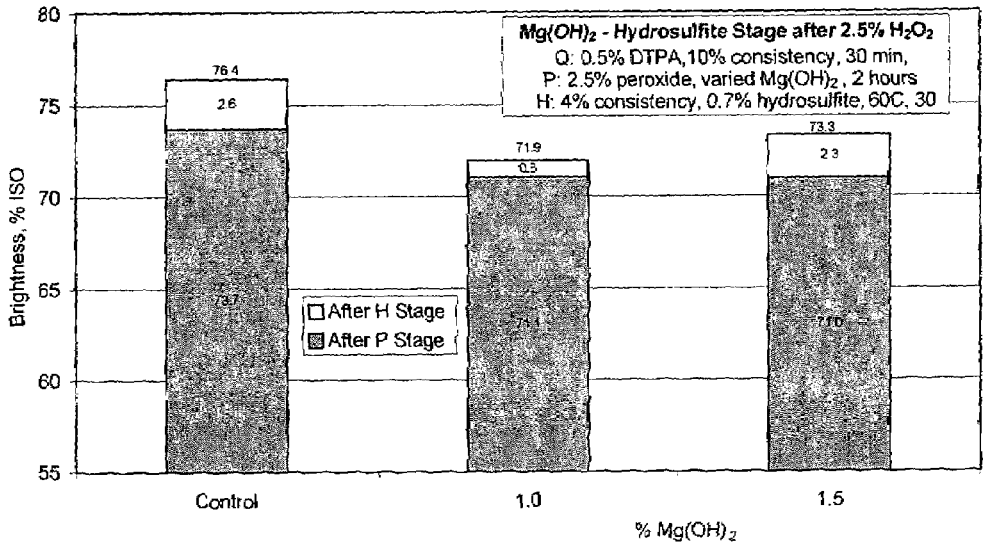
FIG. 33 Northern Groundwood
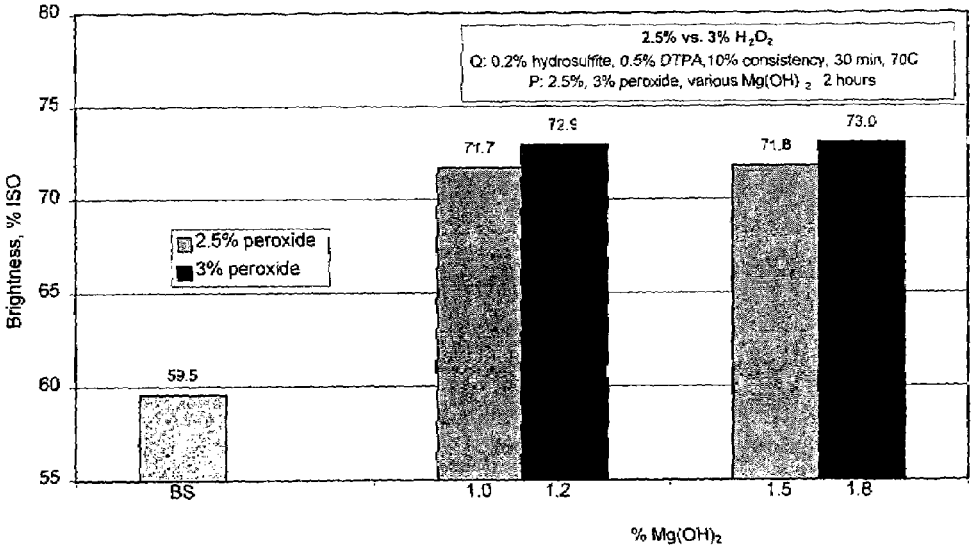

FIG. 34 Northern Groundwood
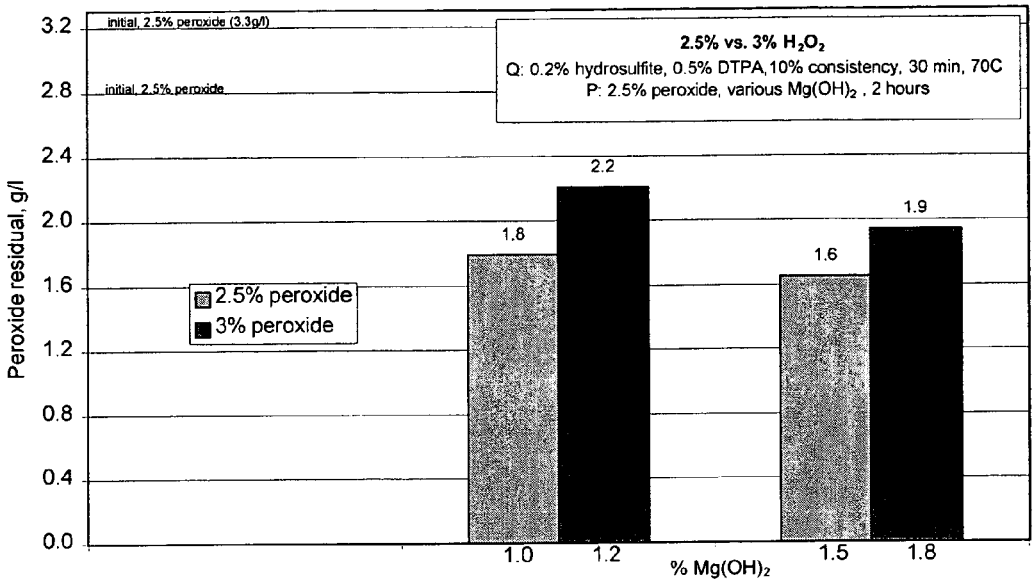
FIG. 35 Northern Groundwood
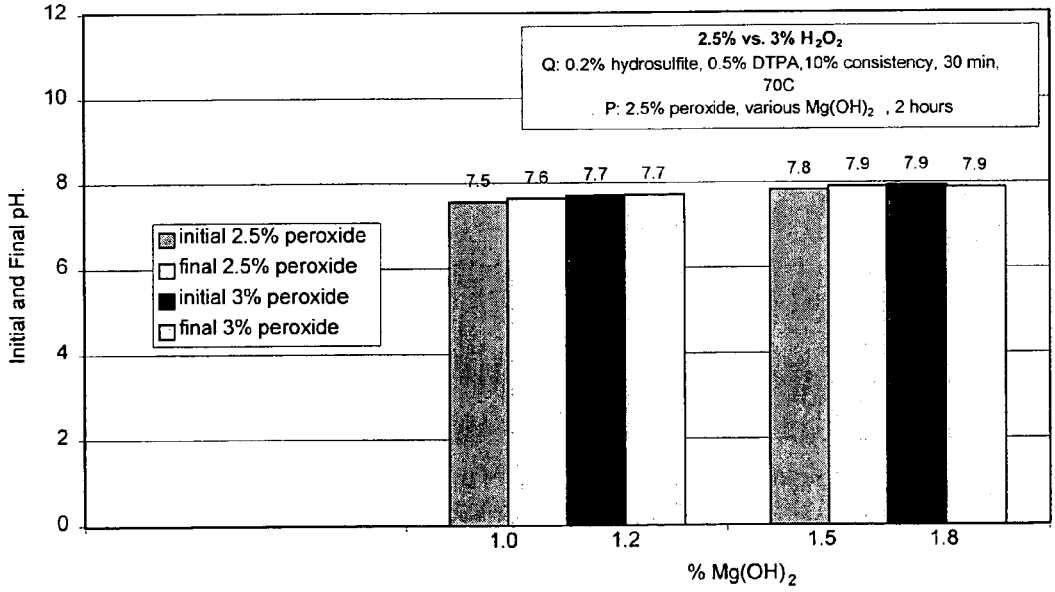

FIG. 36 Northern Groundwood
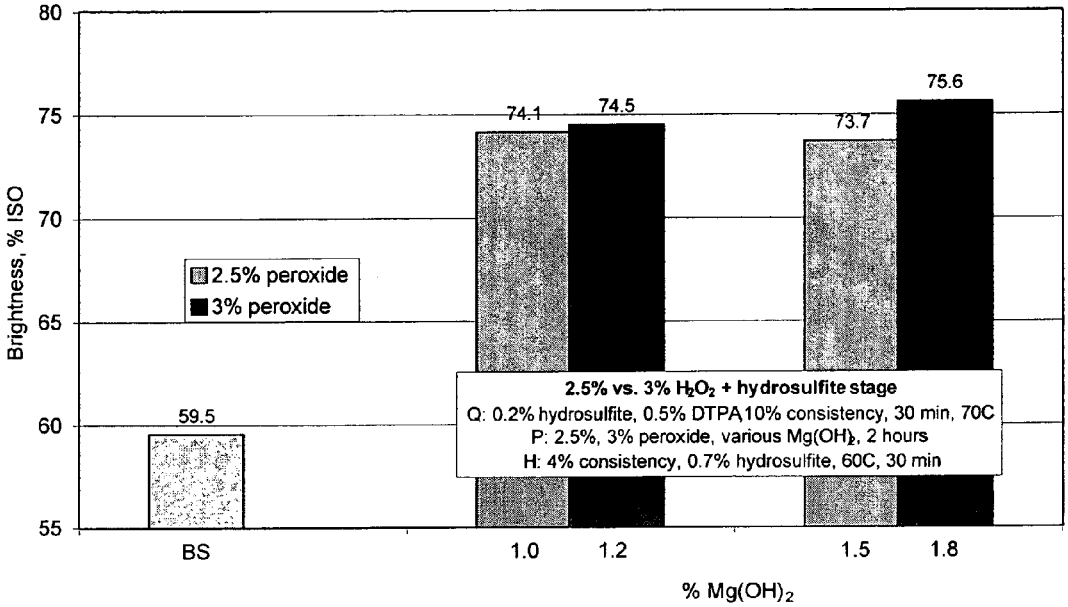
FIG. 37 Northern Groundwood
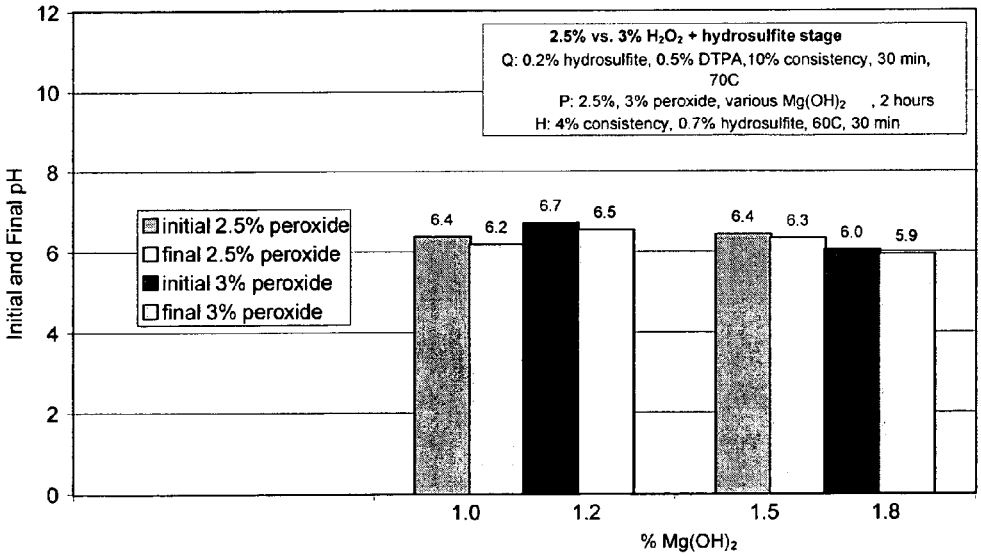

FIG. 38 Northern Groundwood
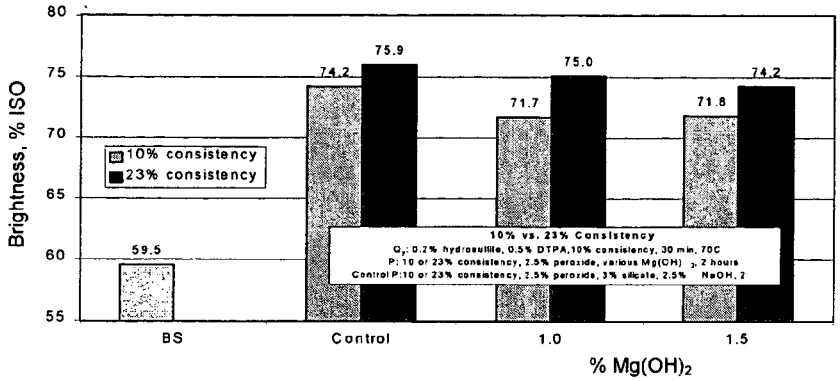
FIG. 39 Northern Groundwood
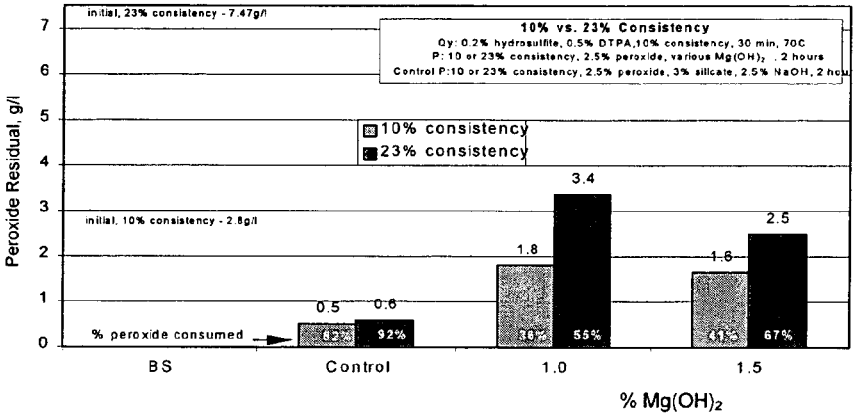
FIG. 40 Northern Groundwood
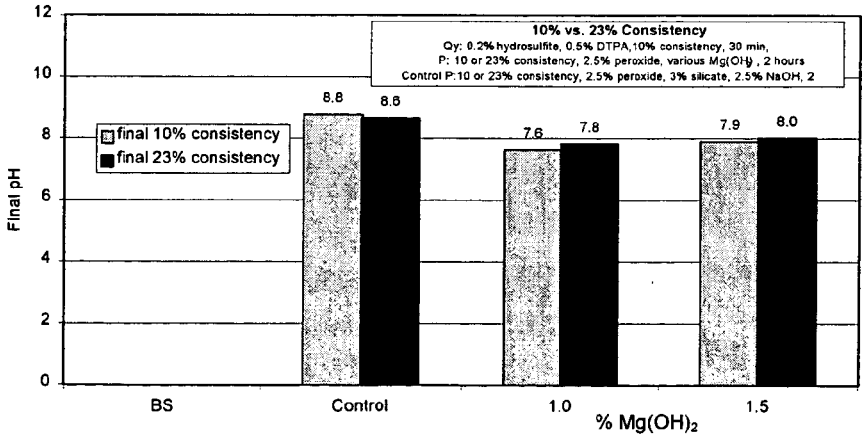

PROCESS EMPLOYING MAGNESIUM HYDROXIDE IN PEROXIDE BLEACHING OF MECHANICAL PULP

This application claims the benefit of Provisional Application No. 60/207,205, filed May 26, 2000, and Provisional Application No. 60/178,704, filed Jan. 28, 2000, which are hereby incorporated by reference.

BACKGROUND OF THE INVENTION

1. Field of the Invention

The present invention relates to bleaching of wood pulps, and in particular to peroxide bleaching of mechanical wood pulps using magnesium hydroxide as a source of alkali.

2. Prior Art

Mechanical pulps are produced from wood using mechanical means only. There are four mechanical pulping processes in use commercially: the stone groundwood (SGW), pressurized stone groundwood (PSGW), refiner mechanical (RMP) and thermomechanical pulp (TMP) pulping processes. The stone groundwood process and the pressurized stone groundwood process use wood bolts while the refiner mechanical and thermomechanical pulping processes use chips. The stone groundwood process is the leading process for mechanical pulping but is rapidly being replaced by the thermomechanical pulping process because there are distinct economies that arise from using chips rather than wood bolts, and the resultant thermomechanical pulp is inherently stronger. In mechanical pulping, no active chemical, other than water, is used to facilitate fiber liberation. Virtually, all of the chemical constituents in the wood are retained in mechanical pulp, including lignin and other chromophores, which cause darkening of the pulp.

Mechanical pulps are typically bleached to enhance their brightness. In the bleaching process, hydrogen peroxide and caustic soda (i.e. sodium hydroxide) are widely used bleaching chemicals. Hydrogen peroxide forms perhydroxyl anions, which are the active bleaching agents. An alkali, such as sodium hydroxide, must be present to provide the hydroxyl anion necessary to generate the perhydroxyl anion. The perhydroxyl anions that are formed release oxygen for slow bleaching of mechanical pulps without degrading the cellulose polymer of the pulp. If hydroxyl radicals are formed instead of perhydroxyl anions, damage to the cellulose polymer will occur and a decrease in pulp strength will result.

Auxiliary chemicals such as caustic soda, sodium silicate, and DTPA (diethylenetriaminepentaacetic acid) or EDTA (ethylenediaminetetraacetic acid) are typically added along with hydrogen peroxide to create a stabilized environment for the formation of perhydroxyl anions. Caustic soda is a strong base that provides the alkalinity and pH (9–11) that are generally thought to be necessary to promote the bleaching process. However, caustic soda can be harsh to pulp fibers. Sodium silicate is typically used as a stabilizer in conjunction with DTPA, a chelant, to prevent catalytic destabilization of hydrogen peroxide into harmful radicals. Both sodium silicate and DTPA are believed to scavenge transition metals such iron, manganese, and copper, which catalyze the decomposition of hydrogen peroxide. Sodium silicate has a disadvantage in that it has a tendency to scale and is abrasive in refiner bleaching.

In peroxide bleaching of mechanical pulp, the main objective is to raise the brightness (whiteness) of the pulp without sacrificing pulp yield. The lignin-carbohydrate matrix should be maintained without dissolving any solid substance other than the extractive components in the wood. Pulp yield is critical because the cost of the raw wood represents a significant portion of the manufacturing cost of pulp.

The mechanical pulp industry uses primarily two bleaching agents: sodium hydrosulfite (sodium dithionite $Na_2S_2O_4$), a reducing agent, and hydrogen peroxide, an oxidative bleaching agent.

Hydrogen peroxide can react with chromophoric groups or sites on the lignin polymer, usually conjugated carbonyl groups that have a propensity for absorbing visible light. Hydrogen peroxide can partially destroy these chromophoric groups, thus raising the brightness or whiteness of the pulp. The ISO brightness scale ranges from 0%, which is a black body, to perfect whiteness of 100%, given by a MgO standard crystal. Depending upon the processing conditions and the age of the wood, unbleached TMP pulp typically has a brightness between 55 to 60 on the ISO scale, compared to unbleached stone groundwood pulp, which is 60 to 65. For mechanical pulp such as TMP, the brightness gain using hydrogen peroxide is typically 10 to 15 brightness units using the ISO brightness scale.

In hydrogen peroxide bleaching, the perhydroxyl anion, $OOH^-$ is generally regarded as the active species that does the bleaching. The perhydroxyl anion occurs through dissociation:

$$H_2O_2 = OOH^- + H^+ \quad (1)$$

The dissociation is strongly affected by pH and to a lesser extent by temperature.

The addition of an alkali and the control of the bleaching temperature can regulate the concentration of the perhydroxyl ion. Adding alkali shifts the equilibrium to the right and raises the concentration of the perhydroxyl anion according to the following equation:

$$H_2O_2 + OH^- = OOH^- + H_2O \quad (2).$$

In bleaching mechanical pulps, the pH is typically maintained in the range between 10.8 to 11.2 with the aid of a buffer, such as sodium silicate, to avoid excess peroxide decomposition. Typical levels of caustic addition range from about 1% to 3%, (wt % based upon the pulp mass), and depending upon the alkalinity of the system.

Decomposition of hydrogen peroxide to forms other than the perhydroxyl anion is to be avoided because hydrogen peroxide is expensive. If the peroxide decomposes to forms other than the perhydroxyl ion, then less perhydroxyl anion is available for bleaching. Hydrogen peroxide dissociates into various free radical species according to the following equations:

$$H_2O_2 = OH^- + OH^+ \quad (3)$$

$$H_2O_2 = OOH^{\bullet} + H^{\bullet} \quad (4)$$

$$H_2O_2 = OH^{\bullet} + OH^{\bullet} \quad (5).$$

The hydroxide free radical ($OH^{\bullet}$) is thought to decompose the carbohydrate components, cellulose and hemicellulose polymers, found in the wood. This is an important consideration when bleaching chemical pulps, but is not a major consideration when bleaching mechanical pulps. Mechanical pulps are added primarily as a filler, but not for strength, and must provide opacity, brightness, and print quality.

Hydrogen peroxide can further decompose to form oxygen through the following reaction with the perhydroxyl ion:

$$H_2O_2 + OOH^- = OH^- + O_2(g) + H_2O \quad (6).$$

The maximum amount of decomposition occurs at 50% dissociation or when the pH is equal to the pK for the dissociation reaction. Approximately 10% of the available hydrogen peroxide decomposes to perhydroxyl anion $OOH^-$ at pH 10.5. The decomposition increases to approximately 95% of the available hydrogen peroxide at pH 12.5. The pH is controlled to a value of 10.8 to 11.2 when bleaching mechanical pulps to control the decomposition of both the perhydroxyl anion and the unreacted peroxide.

The decomposition of hydrogen peroxide is catalyzed by the presence of metal ions, notably manganese, iron, and other transition metals. Overall, the process can be represented by the following equations:

$$2H_2O_2+M^{+2}=M^{+3}+OH^-+OH^{\bullet} \quad (8)$$

$$H_2O_2+M^{+3}=M^{+2}+H^{\bullet}+OOH^{\bullet} \quad (9)$$

$$OOH^{\bullet}=O_2(g)+H^{\bullet} \quad (10)$$

$$H^{\bullet}+OH^{\bullet}=H_2O \quad (11).$$

These decomposition reactions remove peroxide before it can dissociate to form the perhydroxyl anion (given by equation (2)) and participate in bleaching reactions. Metals removal and control of the bleach liquor is an important part of the efficient use of hydrogen peroxide bleaching of mechanical pulps.

Mechanical pulps are typically pretreated. The purpose of pretreating mechanical pulps prior to hydrogen peroxide bleaching is to tie up and wash out most of the transition metals present in the pulp prior to the addition of the bleaching liquor. Metals originate from the wood and the piping system, and both sources must be controlled. There are two principle methods used commercially to manage the metals in peroxide bleaching: (1) by stabilization of the mixture with sodium silicate, and (2) pretreatment and subsequent removal of metals from the pulp with an organic chelating agent.

Adding sodium silicate to the bleach liquor is thought to have two benefits: it significantly reduces peroxide decomposition and it improves the stability of the bleach liquor. Approximately 3% sodium silicate (wt %, based on pulp mass) is added when bleaching mechanical pulps where scaling is not a problem. In cases where scaling is severe, that is, when closed water loops allow buildup, a typical dose rate is 1% to 2%. When bleaching is done in refiners, sodium silicate is avoided to minimize scale buildup and reduced refiner plate life from abrasion. When sodium silicate cannot be used, organophosphonates are sometimes employed. The use of organic stabilizers is not commonly practiced because of poor performance and unfavorable economics.

The exact mechanism by which sodium silicate functions is not precisely known. Sodium silicate is thought to act as a metal ion sequestrant, as a buffering agent, and as a promoter of metal surface passivity. With regard to stabilization, metal sequestration and rendering metal surfaces passive are two important functions of sodium silicate. However, one major disadvantage of sodium silicate is scaling. As a result, there is a need for an inorganic substitute for sodium silicate.

A second common method for metals control involves pulp pretreatment using an organic chelating or sequestering agent. The material must be compatible with the hydrogen peroxide and must also be able to form a complex with the metallic ions. Typically, the pentasodium salt of diethylenetriaminepentaacetic acid ($Na_5DTPA$) is used in this role. The pretreatment is usually carried out at low consistency (consistency being wt % pulp in the pulp-liquor mixture), typically 3–5%, in a latency chest following refining, at a pH of 4 to 6.0. The pulp is then thickened prior to bleaching to moderate or medium consistency (6% to 14%) using a decker (6% to 8%) or disk filter (10% to 14%), or to a high consistency (20% to 25%) using a belt-press or a twin-roll press. This thickening step is very important as the complexed metals are washed from the pulp during the change in solids level. If the thickening step prior to bleaching is not possible, the treatment will still work, but will be less effective. The bleach liquor that is applied to the mechanical pulp to bleach mechanical pulp is a mixture of caustic soda and hydrogen peroxide in water. The bleaching liquor may also have other components to aid the bleaching reactions. Most often it contains some level of sodium silicate (41° Be), usually 1% to 3%, measured on an oven dry basis. Sometimes the bleach liquor will contain magnesium sulfate if it has been determined that extra $Mg^{+2}$ ion will aid in liquor stability, and therefore the overall brightness gain of the pulp. Table 1 gives the composition of typical liquor for bleaching mechanical pulp.

TABLE 1

Typical Peroxide Bleaching Liquor Amount Added Based Upon Pulp

| Component | Amount |
|---|---|
| Hydrogen Peroxide ($H_2O_2$) | 0.5% to 4% |
| Caustic Soda (NaOH), 100% | 1.0% to 2.5% |
| Sodium Silicate[(a)], 41° Be | 2% to 5% |
| DTPA | 0.15% to 0.3% |

[(a)]Water glass with a typical ratio $Na_2O \cdot 3.75SiO_2$

In a typical hydrogen peroxide bleaching process, wood pulp is combined with caustic soda (NaOH), sodium silicate and a chelating/sequestering agent.

The typical hydrogen peroxide bleaching process according to the prior art is characterized by the following problems:

High pH, which must be adjusted prior to discharge of effluent to outfall pipes.

Sodium silicate scaling, which reduces its utility.

Use of caustic soda, which is a strong base, and which tends to degrade wood pulp resulting in relatively low pulp yields and high chemical oxygen demand (COD.)

High concentrations of caustic soda and sodium silicate result in high concentrations of anionic "trash" in bleaching effluent, which in turn requires the use of retention chemicals in later paper-making processes.

While it has been known to use magnesium salts, such as magnesium sulfate ($MgSO_4$), magnesium oxide (MgO) and magnesium hydroxide ($Mg(OH)_2$), in the hydrogen peroxide bleaching of mechanical pulps, it has heretofore been believed that peroxide bleaching must be carried out at elevated pH, e.g. between 10 and 12, in order to ensure sufficient concentration of hydroperoxyl anion ($HOO^-$) to oxidatively destroy chromophoric groups in the wood pulps. Accordingly, it has been known in the art to partially replace sodium silicate or sodium hydroxide with magnesium salts. However, it has not heretofore been known to conduct hydrogen peroxide bleaching of wood pulps at or near neutral pH 5.0–8.5 in the presence of magnesium hydroxide as the alkali source.

There is, therefore, a need for an improved method of bleaching wood pulps with peroxide that does not use sodium silicate or added caustic (e.g., NaOH). There is also a need for a method of bleaching wood pulps that can be performed at neutral pH (e.g., 5.0–8.5), and that produces less COD and anionic trash than prior art methods. There is furthermore a need for a process of bleaching wood pulp that permits economical recycling of unused hydrogen peroxide. There is also a need for a method of bleaching wood pulp that produces brightness values of greater than about 71%, and up to about 75% while excluding added silicate in most cases and/or caustic.

SUMMARY OF THE INVENTION

It is accordingly an object of the invention to provide a process of making a bleached wood pulp from an aqueous slurry of wood pulp to be bleached by bleaching the wood pulp with hydrogen peroxide in the presence of a magnesium compound selected from the group consisting of magnesium hydroxide and magnesium oxide at a pH lower than the pH used with prior art caustic processes.

A further object of the invention is to provide a process of bleaching a wood pulp by washing the wood pulp, contacting the washed wood pulp with a first chelating agent and optionally dewatering to form a washed wood pulp; and bleaching the washed wood pulp with hydrogen peroxide and a magnesium compound selected from the group consisting of magnesium hydroxide and magnesium oxide for a time sufficient to produce the bleached wood pulp.

Other object and advantages of the invention will become apparent as the description thereof proceeds.

In satisfaction of the foregoing objects and advantages, the present invention provides a process for bleaching a mechanical wood pulp to produce a bleached wood pulp product, comprising: preparing a slurry comprising mechanical wood pulp and water; adding to the slurry a bleaching agent comprising hydrogen peroxide and a magnesium compound selected from the group consisting of MgO and $Mg(OH)_2$ to form an aqueous bleaching mixture; contacting said bleaching agent with the wood pulp at a near neutral pH for a sufficient time to produce the bleached wood pulp product, and the recovering pulp product so produced.

In further embodiments, the present invention provides a process of making a bleached wood pulp from an aqueous slurry of wood pulp by combining the wood pulp slurry to be bleached with a composition comprising recycled filtrate comprising residual hydrogen peroxide, optionally fresh hydrogen peroxide and a magnesium compound selected from the group consisting of magnesium hydroxide and magnesium oxide as the bleaching mixture; maintaining the bleaching mixture for a time sufficient to produce the bleached wood pulp; separating the bleached wood pulp from a filtrate comprising water and residual hydrogen peroxide; and recycling at least a portion of the filtrate.

In its broadest embodiment, the present invention relates to an improved process of bleaching mechanical wood pulps with hydrogen peroxide and a magnesium compound at near neutral pH. In this process wood pulp is contacted with hydrogen peroxide in an aqueous liquor at or near neutral pH, wherein magnesium hydroxide or magnesium oxide (which slakes to magnesium hydroxide in situ) is the predominant, and preferably essential, source of alkali in the bleaching liquor. Magnesium hydroxide is a weak base that is relatively insoluble in water. The present inventors have discovered that magnesium hydroxide provides a steady, even supply of alkali for producing perhydroxyl anion, which is the active bleaching species. Thus, as compared to sodium hydroxide, which is a strong base, magnesium hydroxide produces a more consistent concentration of perhydroxyl anions for bleaching, while at the same time producing fewer non-perhydroxyl anion by-products. As a result, hydrogen peroxide bleaching at or near neutral pH using magnesium hydroxide as the essential, and preferably sole, source of alkali produces wood pulps with superior advantages over prior art caustic bleaching.

In other aspects, the present invention provides a hydrogen peroxide bleaching process for wood pulps which occurs at or near neutral pH, e.g. in a pH range of about 5.0 to about 8.5, preferably in a pH range of about 6.5 to about 8.0. The present invention further avoids the problem of sodium silicate scaling by conducting the bleaching substantially in the absence of added sodium silicate. The process for bleaching wood pulp according to the invention, provides improved pulp yield and a concomitant decrease in chemical oxygen demand (COD) by substantially excluding added caustic from the bleaching liquor. The present invention also provides bleached wood pulp products having brightness values similar to those of traditional hydrogen peroxide/sodium hydroxide/sodium silicate bleached pulps, e.g. ISO brightness up to about 75%, without the disadvantages of prior art caustic bleaching process.

In the process of the invention, a method of bleaching wood pulp is provided which is conducted at pH values below or near neutral. As a result, significant amounts of hydrogen peroxide remain in the filtrate after the bleaching procedure. This residual hydrogen peroxide may then be recycled, thereby improving the economics of the process. In addition, when the process is conducted according to the invention, bleaching of the wood pulps at or near neutral pH also results in reduced anionic trash, e.g., up to a 40% reduction. Thus, the bleached wood pulp produced by the process according to the present invention possesses superior paper-making properties, such as improved cationic demand.

These and other advantages of the present invention will become clear to the ordinary artisan upon gaining familiarity with the following description and claims.

BRIEF DESCRIPTION OF THE DRAWINGS

Reference is now made to the drawings accompanying the application wherein:

FIG. 3 is a bar graph of brightness results for a TMP pulp.

FIG. 4 is a bar graph of residual $H_2O_2$ after bleaching of a TMP pulp.

FIG. 5 is a bar graph of initial and final pH values of a TMP pulp.

FIGS. 6–8 are bar graphs of ISO brightness, peroxide residual and pH under various chelation schemes, respectively.

FIGS. 9–11 are bar graphs of ISO brightness, residual peroxide, and pH, respectively, for split $Mg(OH)_2$ additions.

FIGS. 12–14 are bar graphs of ISO brightness, residual peroxide, and pH, respectively, for recycled hydrogen peroxide bleaching.

FIGS. 15–17 are bar graphs of ISO brightness, residual peroxide, and pH, respectively, for recycled hydrogen peroxide bleaching.

FIGS. 18–20 are bar graphs of ISO brightness, residual peroxide, and pH, respectively, for recycled hydrogen peroxide bleaching with repeated use of filtrate containing residual peroxide.

FIGS. 21–24 are bar graphs illustrating the response of ISO brightness, peroxide residual, pH and COD, respectively, at various $Mg(OH)_2$ doses.

FIGS. 25–27 are bar graphs illustrating the response of ISO brightness, peroxide residual, and pH, respectively, at various ratios of chelant to $Mg(OH)_2$.

FIG. 28 shows various properties of pulp made by a process according to the present invention.

FIGS. 29–31 are bar graphs illustrating the response of ISO brightness, peroxide residual, and pH, respectively, to various charges of $Mg(OH)_2$.

FIG. 32 is a bar graph showing the effect of a hydrosulfite stage on the ISO brightness level of bleached pulp.

FIGS. 33–35 are bar graphs illustrating the response of ISO brightness, peroxide residual, and pH, respectively, to different charges of $Mg(OH)_2$ in the presence of hydrosulfite.

FIGS. 36 and 37 are bar graphs illustrating the responses of ISO brightness and initial and final pH, respectively, at different charges of $Mg(OH)_2$.

FIGS. 38–40 are bar graphs illustrating the response of ISO brightness, peroxide residual, and pH, respectively, to different consistency of bleach pulp.

DETAILED DESCRIPTION OF THE INVENTION

The present invention provides a process of hydrogen peroxide bleaching of wood pulp at or near neutral pH, using $Mg(OH)_2$ or MgO as the predominant, and preferably essential, source of alkali. In preferred embodiments according to the present invention, the process substantially excludes added caustic, such as caustic soda (NaOH), and added silicate, such as sodium silicate in most cases.

While $Mg(OH)_2$ is the predominant, and preferably essential, source of alkali, those of skill in the art will recognize that minor amounts of other sources of alkali can be present, such as those sources of alkali that are inherently present in wood pulps, in the $Mg(OH)_2$ and MgO, chelating agents, etc. as minor contaminants, as well as minor amount of other sources of alkali.

Wood pulps for use in the present invention advantageously include mechanical pulps, such as pulps produced by stone groundwood (SGW), pressurized stone groundwood (PSGW), refiner mechanical (RMP) and thermomechanical pulp (TMP) pulping processes. The examples below are primarily directed to TMP processes; however it is to be understood that other mechanical pulping processes can advantageously be used to produce a suitable mechanical pulp that will serve as the raw material, or brown stock, for a process according to the present invention. Additionally, other pulping processes may be used to produce the brown stock, provided that the pulping process produces a pulp that has a significant amount of chromophore that is susceptible to hydrogen peroxide bleaching. The particular pulping process used depends upon the availability of wood stock and the available pulping facilities, and will vary from region to region and from one mill to another.

Wood pulps may be made from any commercially available wood source, whether hardwoods or softwoods, including oak, ash, maple, etc. While the examples set forth below generally employ softwoods, the ordinary artisan will appreciate that other species of wood may be used, and are envisioned as being within the scope of the present invention.

Figure 1:
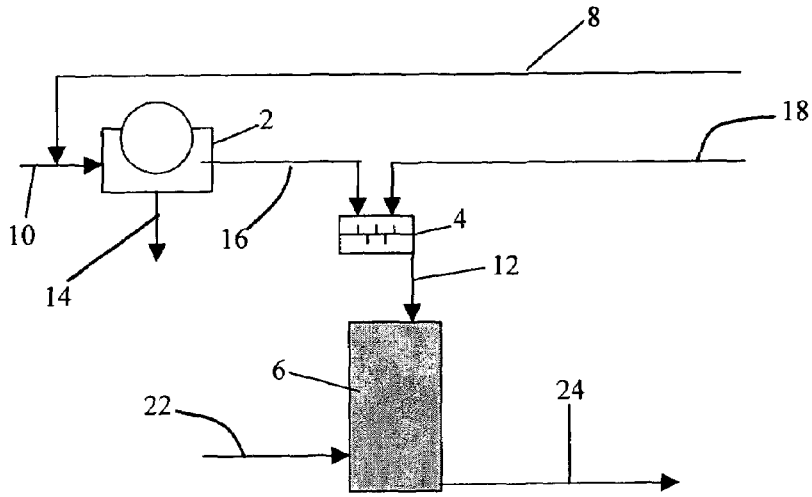
FIG. 1 is block diagram of a peroxide bleaching system according to the present invention.

FIG. 1 illustrates a basic procedure for the bleaching process of the present invention. An unwashed pulp slurry 10 is combined with a charge of chelating agent 8 and is fed into a washer 2. The washer discharges effluent 14, containing waste water and some metals bound up with chelating agent, to waste, and washed pulp slurry 16 to a steam mixer 4. A bleaching liquor 18 comprising water, $Mg(OH)_2$ and/or MgO, and $H_2O_2$ is also charged into the steam mixer 4, which discharges the bleaching mixture 12 to a bleach tower 6. The consistency of the bleaching mixture 12 in the bleach tower 6 is maintained at the desired level by adding water 22 to bleach tower 6. After a reaction period, the bleached pulp 24 is discharged. Further conventional processing steps may then be performed to form the pulp into a useable paper product.

Figure 2:
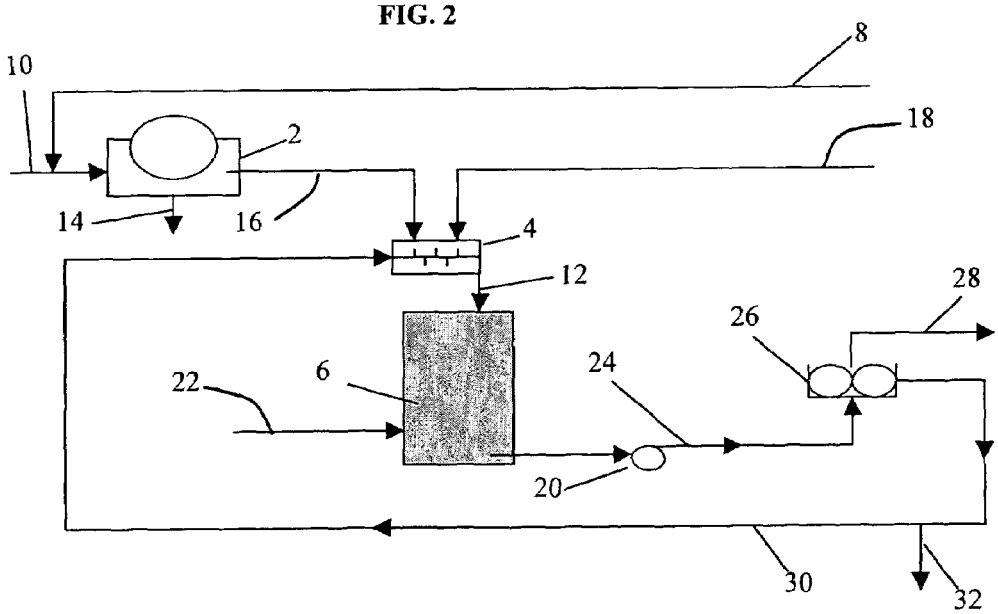
FIG. 2 is block diagram of a peroxide bleaching system according to the present invention, with recycling of residual hydrogen peroxide.

FIG. 2 illustrates an alternative process of the present invention, which includes a recycle step. The same reference numbers are used to indicate analogous steps and materials in FIGS. 1 and 2. As in FIG. 1, an unwashed pulp slurry 10 is combined with a charge of chelating agent 8 and is fed into a washer 2. Advantageously, the washer 2 includes a drum filter or a two-roll press (not shown) that is capable of dewatering the pulp. The washer discharges effluent 14 to waste and washed pulp slurry 16 to a steam mixer 4. A portion of recycled bleaching liquor 30, containing residual hydrogen peroxide, is also charged to steam mixer 4, along with the bleaching liquor 18 comprising water, $Mg(OH)_2$ and/or MgO, and $H_2O_2$. The steam mixer 4 passes the bleaching mixture 12, containing pulp, magnesium hydroxide, and both fresh and recycled hydrogen peroxide to a bleach tower 6. The consistency of the bleaching mixture 12 in the bleach tower 6 is maintained at the desired level by adding water 22 to bleach tower 6. After a reaction period, the bleached pulp 24 is discharged via pump 20 to a press 26, which separates a portion of the bleaching liquor 30 from the bleached, de-watered pulp 28. As can be seen in FIG. 2, this portion of the bleaching liquor 30 is recycled to the steam press 4, where it is combined with pulp 16 and bleaching liquor 18. The bleaching liquor 30 contains unreacted peroxide and may be recycled without further processing or may be treated as desired prior to being recycled such as by the addition of fresh hydrogen peroxide. A portion of bleaching liquor 30 may be removed at line 32 and optionally recycled to this bleaching stage, or a previous stage, recycled at any other point in the system, or sent to effluent.

The unbleached pulp 10 is commonly referred to as a brown stock pulp. In a process according to the present invention, brown stock pulp is produced by any mechanical or other appropriate pulping processes, such as TMP.

The chelating agent 8 is any suitable chelant for sequestering metal ions, and in particular transition metal ions. Suitable chelating agents include diethylenetriaminepentaacetic acid (DTPA), and its salts, such as the pentasodium salt, ethylenediaminetetraacetic acid (EDTA), N-(2-hyroxyethyl) ethylenediaminetriacetic acid (HEDTA), diethylenetriamine pentamethylene phosphonic acid (DTPMPA), cyclic ethers, and salts thereof. Other chelating agents may be used, and the person skilled in the art will recognize that these are contemplated as being within the scope of the present invention. The amount of chelating agent present in the chelation step will vary depending upon, among other things, the level of transition metal contamination in the wood pulp, water, etc. In particular embodiments according to the present invention, the amount of chelating agent present in the chelation step is from about 0.01 wt. % up to about 1.0 wt. %, preferably about 0.1 to 0.5 wt. %, based on the dry mass of the pulp.

The bleaching liquor 18 contains water, $H_2O_2$ and $Mg(OH)_2$ or MgO. The bleaching liquor 18 advantageously contains other chemical agents, such as a chelating agent. While hydrogen peroxide is the preferred bleaching agent, those of skill in the art will understand that the peroxide source could be provided by other compounds such as compounds that would generate the desired peroxide species in situ. The person skilled in the art will recognize that $Mg(OH)_2$ and MgO are relatively insoluble in water, and therefore, with respect to the $Mg(OH)_2$ or MgO, the bleaching liquor is at some concentrations a slurry. In certain embodiments according to the present invention, the $Mg(OH)_2$ or MgO is low in transition metal contaminants. In particular embodiments the $Mg(OH)_2$ or MgO contains less than about 250 ppm Mn and/or less than about 0.15% Fe and/or less than about 250 ppm Cu, based on the equivalent mass of $Mg(OH)_2$. (As the formula weight of MgO is about two thirds that of $Mg(OH)_2$, the respective contaminant levels based on MgO mass will be about one third more than those based on $Mg(OH)_2$.)

Advantageously, the $Mg(OH)_2$ used in the invention will have a BET surface area of about 7 to about 15 $m^2/g$, and the MgO will have a BET surface area of from about 5 to 200 $m^2/g$. As MgO slakes to $Mg(OH)_2$ on addition to water, the BET surface area of MgO is advantageously chosen to produce a $Mg(OH)_2$ slurry having a BET surface area of less than about 40 $m^2/g$, more preferably as low as about 18 to about 20 $m^2/g$, at full hydration. The particle size of the $Mg(OH)_2$ or MgO must be a caustic calcined grade sufficiently small for the slurry to be readily suspendible, advantageously having a $d_{50}$ of less than about 10 microns, preferably less than about 6 μm or less, a $d_{95}$ of about 20 μm or less, and a $d_{98}$ of less than about 45 microns, as determined by the Micromeritics 5100 Sedigraph. The magnesium compound may be added to the bleaching mixture either as a dry powder or as a slurry.

The person skilled in the art will recognize that, while FIGS. 1 and 2 show $Mg(OH)_2$ and/or MgO being added to the bleach slurry via a steam mixer, the exact point of addition of $Mg(OH)_2$ or MgO will advantageously be adapted to a particular mill configuration. In particular embodiments according to the present invention, the $Mg(OH)_2$ or MgO is added to the refiner, into a pipeline leading to the bleaching tower, or directly into the tower. In some embodiments according to the present invention, the $Mg(OH)_2$ charge is split and additions made at more than one point in the system.

In other embodiments according to the present invention, the bleaching liquor 18 further comprises, in addition to water, hydrogen peroxide and $Mg(OH)_2$ or MgO, one or more chelating agents. Suitable chelating agents include the aforementioned DTPA, EDTA or salts thereof or mixtures. As in the case of $Mg(OH)_2$ and MgO, the chelating agent may be introduced into the bleaching tower 6 by any art recognized method, including as an aqueous solution charged directly to the bleaching tower 6. As in the case of $Mg(OH)_2$ or MgO, the chelating agent may be added to the bleaching mixture, to the bleaching tower directly, via a feed line, or, as depicted in FIGS. 1–2, as part of a bleaching liquor 18, in the chelating step, or any other point in the system.

The bleaching mixture 12 is advantageously held in the bleaching tower 6 for a period of time sufficient to attain optimal brightness. The person skilled in the art will recognize that the precise bleaching period will vary from mill to mill, from one pulp to another, based on the consistency of the pulp, etc. In some embodiments according to the present invention, the bleaching period is from about 0.5 hours up to about 6 hours, preferably in the range of about 1 to about 3 hours, more preferably from about 2 to about 3 hours.

In the following discussion, the concentration of various additives, such as chelating agents, hydrogen peroxide and magnesium hydroxide, are given in weight percent (% based on pulp mass). For the purposes of the following discussion, a value of 1% is equivalent to 1 Kg additive per 100 Kg of pulp in the slurry. The consistency of the slurry, where reported, is given in % wt/vol. For instance, a slurry having a consistency of 12 % wt/vol. has 12Kg of pulp per 100 liters of volume.

The pulp slurry 12 in bleaching tower 6 advantageously has a consistency of about 5% to about 35%. The present inventors have noted that the bleaching efficiency tends to increase with increasing consistency, therefore it is desirable that the consistency be at least about 10%, and in preferred embodiments, the pulp consistency will be about 10% to about 23%, more preferably about 15% to 23%.

The bleaching mixture 12 is advantageously heated in the bleaching tower 6 in order to take advantage of the increased bleaching efficiency, e.g. increased speed of bleaching reaction, that is attained at higher temperatures. A suitable temperature range for bleaching is from about 120° F. to about 210° F. (49° C. to 98° C.). The person skilled in the art will recognize that the particular temperature chosen will depend upon the mill, the cost of heating fuel, and the relative increase in reaction speed achieved through heating.

The initial concentration of hydrogen peroxide in the bleaching tower 6 is up to about 6.0 wt. % based on the pulp dry mass. In particular embodiments according to the present invention, the initial hydrogen peroxide concentration is in the range of about 1.0 wt. % to about 6.0 wt. %. The person skilled in the art will recognize that the initial concentration of hydrogen peroxide necessary to attain optimal bleaching may need to be adjusted depending on pulp, desired brightness, etc.

The initial concentration of $Mg(OH)_2$ or MgO in the bleaching tower 6 is from about 0.5 wt. %, preferably 1.0 wt. % to 2.0 wt. %, up to about 5.0 wt. %, based on the pulp dry mass. Unless otherwise specified herein, when speaking of amounts or concentrations of MgO, it is to be understood that the value for MgO is in relation to the pulp dry mass of $Mg(OH)_2$. As the formula weight of $Mg(OH)_2$ (58.33 g/mol) is about 1.5 times that of MgO (40.31), a concentration of MgO equivalent to up to about 5.0% of $Mg(OH)_2$ is up to about 3.5% MgO.

The precise initial dosage of $Mg(OH)_2$ or MgO may be determined empirically, for instance by bleaching a test portion of pulp measuring the pH of the bleaching mixture at the end of the bleaching period, that is the final pH. The initial concentration of $Mg(OH)_2$ should be chosen so that desired brightness is obtained. Usually, the final pH is in the range of about 5.0 to about 8.5, and more preferably in the range of about 6.5 to about 8.0. The person skilled in the art will recognize that the initial pH will be somewhat lower, with the pH gradually rising during the bleaching reaction. The person skilled in the art will furthermore recognize that in the context of the present invention, at or near neutral pH means in the range of about 5.0 to about 8.5.

The foregoing bleaching conditions have been found to produce a bleached wood pulp product having an ISO brightness comparable to that achievable with prior art methods at significantly higher pH values, i.e. in the range of about 10 and higher, while reducing or avoiding altogether problems associated with the higher pH bleaching processes. In particular embodiments according to the present invention, optimal brightness may be achieved when the mass ratio of $Mg(OH)_2$ to $H_2O_2$ is in the range of about 25 parts to about 75 parts of magnesium compound per 100 parts of hydrogen peroxide, based on a $Mg(OH)_2$ equivalence. In these processes, where increased brightness is desired, about 0.1 to 1.0 wt. %, preferably about 0.2 wt. % of a hydrosulphite may be added to the pulp mixture in the chelation stage and/or preferably about 0.7 wt. % in the hydrosulfite stage. Sodium hydrosulphite is preferred.

Under conditions set forth above, the process according to the present invention will produce paper pulp having ISO brightness values comparable to those obtainable using caustic as the main source of added alkali. In some embodiments according to the present invention, the bleached pulps have ISO brightness values of at least about 69% and greater, more preferably at least about 71% and greater, and even more preferably up to about 75%. The bleached pulp also has excellent brightness reversion characteristics, that is, there is little brightness decrease in the pulp over time.

In some embodiments according to the present invention, the bleaching process is carried out in a pH range of about 4.0 to about 8.5, preferably in the range of about 4.9 to about 8.5, using a pulp consistency of 6–25 wt %, preferably 12–25 wt %, with a bleach temperature of about 110° F. to about 140° F. (about 43° C. to about 60° C.) and a bleach time of about 1 to about 6 hours, preferably about 1.5 to about 3 hours. The bleached pulp produced according to the present invention has an ISO brightness of greater than about 69.0%, preferably greater than about 70.0%. The magnesium compound selected from the group consisting of $Mg(OH)_2$ and MgO has a transition metal content of less than about 50 wt % of the transition metal content in a corresponding naturally occurring magnesium compound; preferably the magnesium compound has a transition metal content of less than about 25 wt % of the transition metal content of the corresponding naturally occurring magnesium compound.

As the process according to the present invention is carried out at or near neutral pH, the side reactions that degrade hydrogen peroxide at higher pH values are either eliminated or greatly attenuated. As a result, a significant portion of hydrogen peroxide will be left in the bleached pulp 24 when it is discharged from the bleaching tower 6. In certain embodiments according to the present invention, it is economical to recover a portion of the residual hydrogen peroxide in bleached pulp 24. This is accomplished, as stated above, by passing the bleached pulp 24 through a press 26, where recovered bleaching liquor 30 is separated from bleached pulp product 28. The recovered bleaching liquor 30 is recycled to the bleaching tower 6, optionally through the steam mixer 4. As the consistency of the pulp in bleaching tower 6 must be carefully controlled, it is not always possible to recycle all the recovered bleaching liquor 30. As the amount of hydrogen peroxide in the bleaching liquor 30 is usually lower than required for optimal bleaching, an aliquot of fresh hydrogen peroxide may be added to the bleaching tower 6 via, for instance, bleaching liquor 18. The ratio of recycled to fresh hydrogen peroxide is advantageously in the range of about 0:1 to about 1:1, and more preferably the ratio of recycled to fresh peroxide is 0.05:1, 0.1:1 and 0.2:1.

In a further aspect of the present invention, either $H_2O_2$ or $Mg(OH)_2$ or both may be added in more than one aliquot to the bleaching tower 6. In other embodiments according to the present invention, each of hydrogen peroxide and magnesium hydroxide is added in a single charge.

Where chelating agent is added in the bleaching stage, the concentration of chelating agent, such as DTPA, may be stated as a ratio with respect to the concentration of $Mg(OH)_2$. For instance, where the chelating agent is DTPA, and a charge of 0.05%, 0.1%, 0.15% or 0.2% DTPA is used, the ratio of DTPA/$Mg(OH)_2$ is in the range of about 0.03 to about 0.25. Where DTPA is present in a concentration of about 0.1%, the ratio of DTPA to $Mg(OH)_2$ is 0.03, 0.04, 0.05, 0.07, 0.10, 0.15, 0.20 or 0.25. The amount of DTPA may be adjusted in relation to the amount of $Mg(OH)_2$ present as well. For instance, where $Mg(OH)_2$ is present in a concentration of about 1.0%, the ratio of DTPA to $Mg(OH)_2$ is 0.03, 0.04, 0.05, 0.07, 0.10, 0.15, 0.20 or 0.25. Persons skilled in the art will recognize that other values of DTPA/$Mg(OH)_2$ ratios are possible, and the foregoing are merely illustrative. See Table 10. In any case, the chelating agent is preferably added in a concentration of up to about 0.1 wt. %, preferably up to 0.5 wt. % based on pulp dry weight.

In a preferred aspect of the present invention, the process includes two separate steps, a Q stage and a P stage. The Q stage, or chelation stage, is prior to the washing step in washer 2, as previously described. The P stage, or peroxide stage, roughly correlates to the bleaching stage carried out in the bleaching tower 6, as described above. In the Q stage, chelating agent is added up to a concentration of about 0.5% based on the pulp dry weight. The chelating agent is allowed to contact the pulp for a time of up to about 30 minutes. Then the pulp is dewatered to remove excess water and transition metals that have been sequestered by the chelating agent.

The P stage, or bleaching step, is allowed to progress for a period of time to allow for complete bleaching of the pulp. The pulp and bleaching liquor may be mixed together for a period of time while samples of pulp are extracted from time to time to test for brightness. In such instances, the bleaching liquor is removed from the pulp when the pulp reaches the desired brightness, or when the pulp reaches maximum brightness as determined by a plot of brightness versus bleaching time. The ordinary artisan will appreciate that various bleaching times will be required for various species and qualities of pulp wood, and that these are considered to be within the scope of the present invention.

The proportions of recycled and fresh hydrogen peroxide used will vary, depending in part upon the amount of recycled residual hydrogen peroxide recovered in the recovery stage. The preferred total amount of hydrogen peroxide present generally comprises about 50% to about 95% fresh hydrogen peroxide and about 5% to about 50% recycled hydrogen peroxide. More preferably, the total amount of hydrogen peroxide comprises about 10% to about 40% of recycled hydrogen peroxide, with the remainder of total hydrogen peroxide being fresh hydrogen peroxide (i.e. about 60% to about 90%). In even more preferred aspects, the total hydrogen peroxide is made up of about 40% recycled hydrogen peroxide, the remaining 60% being fresh hydrogen peroxide. In exemplary embodiments according to the present invention, total hydrogen peroxide is about 10%, 20%, 25%, 30% or 40% recycled hydrogen peroxide, the remainder in each case being fresh hydrogen peroxide.

The process of the invention includes a bleaching step that preferably takes place at or near neutral pH, e.g. from a pH of about 5.0 to about 8.5. In some cases, the brown stock pulp starts out at a pH of between 4.0 and 5.5, and after addition of magnesium hydroxide and hydrogen peroxide, the pH gradually rises to a point between 7.0 and 8.1. The skilled artisan will recognize that this pH range is significantly lower than the typical pH range of 10 to 12 associated with caustic soda mediated hydrogen peroxide bleaching.

The pH of pulp upon exiting the bleaching tower is in the range of about 5.0 to about 8.5, more preferably in the range of about 6.5 to about 8.0.

The present invention uses magnesium hydroxide or magnesium oxide as the predominant, and preferably essential, source of added alkali in hydrogen peroxide bleaching of mechanical pulps, such as TMP. The present invention thus avoids the use of both added caustic, such as sodium hydroxide, and silicate, such as sodium silicate. The substitution of one chemical for two results in cost savings. The resulting bleaching liquor is considerably gentler on the pulp. As a result, the process of the invention gives better pulp yield, as evidenced by lower chemical oxygen demand (COD) than the prior art caustic soda process. The process also results in lower levels of anionic trash, i.e. cationic demand, which reduces the amount of retention chemicals necessary to produce paper in downstream processes. Because magnesium hydroxide and magnesium oxide have relatively low solubility, activation of hydrogen peroxide to the perhydroxyl anion is slower but more consistent in concentration in the present invention as compared with the prior art. As a result, the hydrogen peroxide undergoes fewer side-reactions and there is sufficient residual hydrogen peroxide at the end of the bleaching step to make it feasible to recycle at least a portion of the bleaching liquor comprising residual peroxide. The process according to the present invention furthermore produces a pulp having ISO brightness and reversion characteristics similar to or better than those produced by prior art processes.

EXAMPLES

The following examples are presented to illustrate the present invention. The person skilled in the art will recognize that these examples are purely illustrative and are not intended to limit the scope of the present invention. In the examples and throughout the application, parts are by weight unless otherwise indicated.

Experiments were performed to investigate the use of magnesium hydroxide, $Mg(OH)_2$, and magnesium oxide, MgO as alkali sources and stabilizing agents in peroxide bleaching of TMP. Control experiments were conducted using caustic soda, sodium silicate, and DTPA. A direct comparison was made between $Mg(OH)_2$, MgO, NaOH, and $NaSiO_3$. The effect of particle size of $Mg(OH)_2$ was also evaluated.

Hydrogen peroxide bleaching experiments were performed on softwood TMP from a northeastern mill after refining (TMP#1). The brightness of this TMP#1 brownstock was 62.0% ISO. The "best case" parameters from these bleaching tests were used to test another softwood TMP from another northeastern mill after refining (TMP#2).

The chelation stage employed DTPA and 10% consistency pulp at 70° C. for 30 minutes. In the hydrogen peroxide stage, sodium silicate and caustic soda were added to the pulp at 70° C. Bleaching time was varied from 1 to 6 hours. The base case or control sample used the standard bleaching recipe as given in Table 1. In further bleaching cases, DTPA was also added at the hydrogen peroxide stage.

All results are reported in Table 2, which also shows the conditions used. FIGS. 3 and 4 show the brightness data and peroxide residual data, respectively. Data for pH can be seen in FIG. 5.

Comparative Bleaching Experiments for TMP#1 Pulp

Chelation. The chelation stage was first tested. Three experiments were done using the appropriate chemical: (1) blank, using distilled water, (2) mill conditions, using 0.3% DTPA, and (3) $Mg(OH)_2$ substitution, using 0.363% $Mg(OH)_2$. The brightness results are shown in FIG. 3. The blank and DTPA chelation show approximately the same brightness gain, going from a brownstock value of 62.0% to 63.4% ISO for the blank and 63.8% for the DTPA chelation. The $Mg(OH)_2$ chelation darkened the pulp to 58.0% ISO. Since this $Mg(OH)_2$ darkened the pulp, no further work was done on this $Mg(OH)_2$ chelated pulp. Further experiments were done using DTPA chelated pulp, at either 0.2% or 0.3% in the chelation stage.

Base Case (Control employing caustic and silicate). Mill conditions were followed for the base case, and three reaction times were examined: 1, 2, and 3 hours. A 0.3% DTPA chelation stage was used, and 3% $Na_2SiO_3$, 1.6% NaOH, and 2% $H_2O_2$ in the peroxide stage. Results are found in Table 2. FIG. 3 shows the brightness values for the three reaction times. There was little difference in brightness values for the three reaction times, ranging from 72.5% to 73.1% ISO. Peroxide residual was also similar for the three reaction times—however, it did decrease slightly with reaction time, from 0.48 g/l at one hour to 0.37 g/l at three hours. The initial pH was similar for all three experiments, and the final pH was lower for the longer reaction times, 8.7 at one hour to 7.7 at three hours. These results led to choosing a two hour reaction time for the next set of experiments.

Case 1. Case 1 experiments replace sodium silicate with magnesium hydroxide. The 0.3% DTPA chelation stage was kept the same. The hydrogen peroxide dose was held at 2%, while the $Mg(OH)_2$ dose was changed from 0.5 to 1.5%. The NaOH charge was varied to reach the initial pH target of 11.2 to 11.8. Results are found in Table 2. FIG. 3 shows the ISO brightness values, while FIGS. 4 and 5 show the residual $H_2O_2$ and pH, respectively.

This case produced pulp having inferior brightness as compared to the base case, where the bleaching reaction was carried out in the presence of added caustic and silicate. The base case two hour reaction time resulted in a brightness of 72.5% ISO, whereas the best condition for Case 1 experiments, 0.5% $Mg(OH)_2$, resulted in a brightness of 62.5% ISO. Higher levels of $Mg(OH)_2$ resulted in lower brightness values. There is little peroxide residual under these conditions. The initial and final pH values are similar to the base case.

Case 1-A. Since $Mg(OH)_2$ was being added in the peroxide stage, two experiments were done adding DTPA to the peroxide stage, in addition to the chelating stage. The same total amount of chelant was added, 0.3%, but 0.2% was used in the chelation stage, and 0.1% added during the peroxide stage. 0.5% $Mg(OH)_2$ was used in both experiments, but two lower doses of peroxide were used, 1% and 1.5%. These results are shown in Table 2. As is shown, the addition of chelant in the peroxide stage increased the brightness over the Case 1 results, even with a lower peroxide charge. At the 1.5% peroxide charge, the brightness attained 64.7% ISO, a 2 point increase over the Case 1 results. However, that value is still almost 8 points lower than the base case.

These results caused the remaining experiments to be done with the chelant charge split between the chelation stage and the peroxide stage.

Case 2. Case 2 experiments replace both sodium silicate and sodium hydroxide with magnesium hydroxide. The chelation stage used 0.2% DTPA. The peroxide stage was charged with 0.1% peroxide, 2% $H_2O_2$, and four doses of $Mg(OH)_2$, from 0 to 1.5%, were tested. Reaction time was two hours. The results are in Table 2.

The best result for this set of experiments is again at 0.5% $Mg(OH)_2$, where the brightness is 70.3% ISO, approaching the base case of 72.5% ISO. It is an eight point increase over the Case 2 results at the same $Mg(OH)_2$ and peroxide dosages, but without NaOH, and with chelant added at the peroxide stage. These conditions also result in a substantial peroxide residual, 0.97 g/l at 0.5% $Mg(OH)_2$. The pH for these experiments is lower than for the other experiments. Without the silicate or caustic, the initial pH with the $Mg(OH)_2$ is 6.5 to 7, and the final pH increases to 7.3 to 8.2, higher with the higher $Mg(OH)_2$ charge.

The results of these experiments showed that the brightness of the base case could be approached using magnesium hydroxide. There was still residual peroxide at 0.5% $Mg(OH)_2$ charge, and so potential for further reaction. Case 2-A increased the reaction time. Case 2-B increased the peroxide charge applied.

Case 2-A. These experiments follow the conditions of Case 2 experiments, but with the $Mg(OH)_2$ charge held at 0.5%, and the peroxide charge varied.

Increasing the peroxide charge increased the brightness gain. At 3% peroxide charge in Case 2-A, the brightness increased to 72.4% ISO, which is very similar to the base case value of 72.5% ISO, at the two hour reaction time.

Case 2-B. These experiments follow the conditions of Case 2 experiments, but with the $Mg(OH)_2$ charge held at 0.5%, and the reaction times varied.

Increasing the reaction time increased the brightness, and a six hour reaction time gave a brightness of 71.6% ISO. This is about a point below the base case value of 72.5% ISO at two hour reaction time.

Case 3. Case 3 experiments screen some other particle sizes of $Mg(OH)_2$, as well as Natural MgO and MagChem 35, a commercially available MgO. The 0.415 micron $Mg(OH)_2$ was the material used in all other experiments.

There was little difference in the brightness response for the different sizes of $Mg(OH)_2$, all about 70% ISO. The Natural MgO response was worse than all others, by about 3 points, and the MagChem 35 MgO response was somewhat better, 71.1% ISO due to the higher magnesia charge on a chemical equivalent $Mg(OH)_2$ basis.

Base Case brightness results could be approached without silicate or caustic addition, by peroxide bleaching with the addition of DTPA and $Mg(OH)_2$ in the peroxide stage. Base Case results could be reached by increasing peroxide charge, and closely approached by increasing reaction time to six hours.

A 0.5% $Mg(OH)_2$ charge seemed optimum with conditions used at this point.

Particle size of $Mg(OH)_2$ did not seem to have much effect.

Natural MgO contains more transition metals such as manganese and iron which resulted in a lower brightness (67.16% ISO) and lower peroxide residual. This indicates that the high concentration of transition metals caused the peroxide to decompose.

Magnesium hydroxide and magnesium oxide appear to give similar brightness to the base case at a neutral pH. This contradicts the conventional belief that peroxide bleaching is optimum at an alkaline pH range of 10.8 to 11.0. Since magnesium hydroxide and magnesium oxide have a low solubility relative to caustic soda, hydroxyl ions ($OH^-$) are only sparingly soluble to promote the formation of perhydroxyl anions ($OOH^-$). From the data, magnesium hydroxide/magnesium oxide seem to provide just enough hydroxyl ions to shift the equilibrium favorably to the right for perhydroxyl anion formation. As a result, comparable brightness is achieved at a lower pH yielding a high residual peroxide concentration. Further optimization can determine if this residual peroxide can be recycled for additional bleaching reactions.

The columns headed L, a, and b contain HunterLab™ color numbers. The "L" number indicates brightness, which ranges from 0 (black body) to 100 (perfect brightness). The "a" number indicates red (+a) to green (−a), while the "b" number indicates yellow (+b) to blue (−b). One familiar with this system of color coding can envision the color by knowing the L-a-b numbers.

TABLE 2

Bleaching results for TMP#1 pulp with 10% pulp consistency

| | Sample ID | DTPA | $Na_2SiO_3$ | NaOH | $H_2O_2$ | $Mg(OH)_2$ | Initial pH | Final pH | Residual $H_2O_2$ (g/l) | Brightness %, ISO | Color L | a | b |
|---|---|---|---|---|---|---|---|---|---|---|---|---|---|
| TMP | U-1-1 | | | | | | | | | 62.04 | 87.85 | 0.31 | 12.83 |
| Chelation | Blank | | | | | | | 4.80 | | 63.42 | 88.38 | 0.28 | 12.34 |
| | DTPA | 0.3% | | | | | | | | 63.79 | 88.66 | 0.25 | 12.39 |
| | $Mg(OH)_2$ | $Mg(OH)_2$ = 0.363% | | | | | | 8.15 | | 58.02 | 85.07 | 0.26 | 12.55 |
| Base | 1 hr | 0.3% | 3% | 1.56% | 2.0% | 0.00% | 11.23 | 8.70 | 0.476 | 72.66 | 92.69 | −1.81 | 10.89 |
| | 2 hrs | 0.3% | 3% | 1.56% | 2.0% | 0.00% | 11.06 | 8.00 | 0.394 | 72.46 | 92.78 | −2.15 | 11.13 |
| | 3 hrs | 0.3% | 3% | 1.56% | 2.0% | 0.00% | 11.09 | 7.70 | 0.374 | 73.09 | 92.95 | −1.76 | 10.89 |
| Case 1** | 2 hrs | 0.3% | 0 | 1.56% | 2.0% | 0.50% | 11.60 | 8.00 | 0.007 | 62.53 | 87.86 | −0.17 | 12.44 |
| | 2 hrs | 0.3% | 0 | 1.56% | 2.0% | 1.00% | 11.80 | 8.20 | 0.003 | 60.76 | 87.00 | 0.18 | 12.70 |
| | 2 hrs | 0.3% | 0 | 0.84% | 2.0% | 1.50% | 11.20 | 8.30 | 0.003 | 60.31 | 86.55 | 0.04 | 12.50 |
| Case | 2 hrs | 0.2%, 0.1% | 0 | 0.72% | 1.0% | 0.50% | 10.50 | 8.25 | 0.014 | 63.75 | 88.38 | −0.34 | 12.15 |
| 1-A** | 2 hrs | 0.2%, 0.1% | 0 | 0.80% | 1.5% | 0.50% | 10.50 | 8.30 | 0.020 | 64.72 | 89.03 | −0.59 | 12.21 |
| | 2 hrs | 0.2%, 0.1% | 0 | 1.00% | 2.0% | 0.50% | 10.53 | 8.00 | 0.075 | 66.37 | 89.89 | −0.81 | 12.03 |
| Case 2** | 2 hrs | 0.2%, 0.1% | 0 | 0 | 2.0% | 0.00% | 4.90 | 5.17 | 1.972 | 65.90 | 90.08 | −0.06 | 12.47 |
| | 2 hrs | 0.2%, 0.1% | 0 | 0 | 2.0% | 0.25% | | 6.43 | 1.666 | 69.53 | 91.71 | −0.98 | 11.98 |
| | 2 hrs | 0.2%, 0.1% | 0 | 0 | 2.0% | 0.50% | 6.50 | 7.28 | 0.966 | 70.26 | 91.92 | −1.35 | 11.66 |
| | 2 hrs | 0.2%, 0.1% | 0 | 0 | 2.0% | 1.00% | 7.07 | 7.67 | 0.245 | 67.08 | 90.40 | −0.84 | 12.10 |
| | 2 hrs | 0.2%, 0.1% | 0 | 0 | 2.0% | 1.50% | 7.07 | 8.15 | 0.014 | 62.58 | 87.96 | −0.38 | 12.45 |
| Case | 2 hrs | 0.2%, 0.1% | 0 | 0 | 1.5% | 0.50% | 6.83 | 7.59 | 0.578 | 68.44 | 91.21 | −0.90 | 12.14 |
| 2-A* | 2 hrs | 0.2%, 0.1% | 0 | 0 | 2.5% | 0.50% | 7.06 | 7.52 | 1.299 | 71.24 | 92.49 | −1.23 | 11.66 |
| | 2 hrs | 0.2%, 0.1% | 0 | 0 | 3.0% | 0.50% | 7.23 | 6.70 | 1.877 | 72.36 | 92.97 | −1.50 | 11.41 |
| Case | 3 hrs | 0.2%, 0.1% | 0 | 0 | 2.0% | 0.50% | 6.51 | 6.94 | 0.870 | 70.62 | 92.39 | −1.38 | 11.98 |

TABLE 2-continued

Bleaching results for TMP#1 pulp with 10% pulp consistency

| | Sample ID | DTPA | $Na_2SiO_3$ | NaOH | $H_2O_2$ | $Mg(OH)_2$ | Initial pH | Final pH | Residual $H_2O_2$ (g/l) | Brightness %, ISO | Color L | a | b |
|---|---|---|---|---|---|---|---|---|---|---|---|---|---|
| 2-B** | 4 hrs | 0.2%, 0.1% | 0 | 0 | 2.0% | 0.50% | 6.49 | 6.42 | 0.870 | 71.15 | 92.73 | −1.42 | 11.99 |
| | 6 hrs | 0.2%, 0.1% | 0 | 0 | 2.0% | 0.50% | 6.53 | 6.08 | 0.775 | 71.63 | 93.02 | −1.58 | 12.05 |
| Case 3* | 3.101 microns | 0.2%, 0.1% | 0 | 0 | 2.0% | 0.50% | 5.71 | 7.09 | 0.891 | 69.77 | 91.71 | −1.060 | 11.70 |
| | 0.65 microns | 0.2%, 0.1% | 0 | 0 | 2.0% | 0.50% | 6.28 | 7.05 | 1.122 | 70.29 | 92.03 | −1.150 | 11.74 |
| | 0.603 microns | 0.2%, 0.1% | 0 | 0 | 2.0% | 0.50% | 6.31 | 6.99 | 1.021 | 70.31 | 92.04 | −1.110 | 11.70 |
| | Natural $Mg(OH)_2$ | 0.2%, 0.1% | 0 | 0 | 2.0% | 0.50% | 4.92 | 7.10 | 0.394 | 67.16 | 90.32 | −0.700 | 11.89 |
| | MagChem 35 MgO | 0.2%, 0.1% | 0 | 0 | 2.0% | 0.50% | 7.78 | 6.69 | 0.510 | 71.13 | 92.53 | −1.320 | 11.73 |

*reaction time 2

**$Mg(OH_2)$---P277-262-1(0.415 micron) was

Additional work was performed to test 'best case' conditions from this study on TMP#2 pulp.

Bleaching Experiments for TMP#2 Pulp

Chelation. As with the experiments conducted for TMP#1 pulp, the chelation stage was first tested for TMP#2 pulp. Three experiments were done using the appropriate chemical: (1) blank, using distilled water, (2) mill conditions, using 0.3% DTPA, and (3) $Mg(OH)_2$ substitution, using 0.363% $Mg(OH)_2$. The brightness results are shown in Table 3. The blank and DTPA chelation show approximately the same brightness gain, going from a brownstock value of 60.9% to 60.5% ISO for the blank and 60.6% for the DTPA chelation. Again, the $Mg(OH)_2$ chelation darkened the pulp to 56.1%. Since the $Mg(OH)_2$ darkened the pulp, no further work was done on $Mg(OH)_2$ chelated pulp. All further experiments were done using DTPA chelated pulp, at either 0% to 0.3% in the chelation stage.

Base Case. Mill conditions were followed for the base case, and two reaction times were examined, 2 and 5 hours. A 0.3% DTPA chelation stage was used in addition to 3% $Na_2SiO_3$, 1.44% NaOH, and 2% $H_2O_2$ in the peroxide stage. Results are found in Table 3. FIG. 6 shows the ISO brightness values for the two reaction times, while FIGS. 7 and 8 show the residual peroxide and pH, respectively. As with the TMP#1 pulp, there was little difference in brightness values for the two reaction times for the TMP#2 pulp. Brightness values for 2 and 5 hours were 69.8% and 70.3% ISO, respectively. Peroxide residual was also similar for the two reaction times—however, it did decrease slightly with reaction time, from 0.714 g/l at two hours to 0.646 g/l at five hours. The initial pH was similar for both experiments, and the final pH was lower for the longer reaction time, 8.1 at two hours to 7.3 at five hours.

The following experiments replace caustic soda and sodium silicate with DTPA and magnesium hydroxide or magnesium oxide.

Varying Particle Size. In this set of experiments, $Mg(OH)_2$ with varying median particle sizes (as measured by a Micromeritics 5100 Sedigraph) were added to the peroxide stage at 0.50%. A 2 hour reaction time was employed for these experiments. DTPA was added to the peroxide stage in addition to the chelating stage. The same total amount of chelant was added, 0.3%, but 0.2% was used in the chelation stage, and 0.1% added during the peroxide stage. The peroxide dosage was kept constant at 2.0%.

There was little difference in the brightness response for the different sizes of $Mg(OH)_2$. Brightness values were either 68.6% or 68.7% ISO as seen in Table 3. As a result, the 0.415 micron $Mg(OH)_2$ was used for subsequent experiments. These brightness values are slightly lower than the base case at two hours and 0.3% DTPA in the chelation stage (69.8% ISO) but were achieved at a significantly lower initial pH (5.3 to 6.0).

Varying Chelant. The DTPA dosage was varied in both the chelation stage and peroxide stage while the $Mg(OH)_2$ dosage (0.415 micron) and peroxide dosage were kept constant at 0.50% and 2.0%, respectively. A 5 hour reaction time was used. As Table 3 shows, $Mg(OH)_2$ in the peroxide stage with no DTPA in both the chelation and peroxide stage results in the lowest brightness value (64.4% ISO) and peroxide residual (0.218 g/L). Adding 0.2% DTPA just in the chelation stage with $Mg(OH)_2$ in the peroxide stage produced a higher brightness (69.5% ISO) than 0.1% DTPA added just in the peroxide stage (67.3% ISO). Splitting the DTPA charge between the chelation and peroxide stage yielded similar brightness values to 0.2% DTPA just in the chelation stage. Results can be seen in Table 3. Brightness, peroxide residual, and pH values can be seen in FIGS. 6, 7, and 8, respectively. Again, the pH for these experiments is lower than for the base case experiments. Without the silicate or caustic, the initial pH with the $Mg(OH)_2$ is 5.5 to 6.3, and the final pH increases to 6.1 to 6.7.

The best result for this set of experiments is at 0.15% DTPA in the chelation stage and 0.05% DTPA in the peroxide stage (69.5% ISO). This brightness value again approaches the base case of 70.3% ISO at 5 hours reaction time. These conditions, however, also result in a substantial peroxide residual of 1.408 g/l compared to the base case of 0.646 g/L. With the higher peroxide residual, there is potential for further reaction.

Using MgO. In place of $Mg(OH)_2$, 0.50% MgO was substituted in the peroxide stage. A two hour reaction time with a split DTPA charge of 0.2% in the chelation stage and 0.1% in the peroxide stage was employed. As with other experiments for the TMP#2 pulp, a 2% peroxide dosage was kept constant. Compared to $Mg(OH)_2$ at the same conditions, a higher brightness was achieved with the MgO (70.1% ISO). This is higher than the base case at a two hour reaction time and 0.3% DTPA (69.8% ISO). The peroxide residual, however, was higher for the MgO (1.394 g/L) than the base case (0.646 g/L). Magnesium hydroxide at the same conditions produced an even higher peroxide residual (1.66 to 1.67 g/L).

At a 5 hour reaction time and lower DTPA charge (0.15% in the chelation stage, 0.05% in the peroxide stage), the MgO had a similar brightness to the previous experiment (70.0% ISO versus 70.1% ISO). This brightness is also comparable to the base case at a 5 hour reaction time and higher DTPA dosage of 0.3% (70.3% ISO). This experiment not only indicates a full substitution for caustic soda and sodium silicate with MgO, but a lower DTPA requirement to achieve comparable brightness. Compared to $Mg(OH)_2$ at the same conditions, the MgO case again resulted in a higher brightness (69.5% versus 70.0% ISO).

In both MgO experiments, a higher initial pH was achieved when compared to the $Mg(OH)_2$ cases. However, the initial pHs were still significantly lower than the base case.

The results can be seen in FIGS. 6, 7, and 8.

I. A Comparison of Bleaching Results for TMP#1 and TMP#2

Comparing the TMP#1 and TMP#2 experiments that were conducted at similar bleaching conditions, it can be shown that there was little bleaching response difference between the different particle sizes for $Mg(OH)_2$. Both northeastern softwood TMP pulps behaved similarly given the same bleaching conditions for the base case, $Mg(OH)_2$ case, and MgO case.

Table 4 shows the results for both TMP#1 and TMP#2 experiments with MgO and varying particle size $Mg(OH)_2$ samples.

FIGS. 6–8 depict the brightness, peroxide residual, and pH values. Addition of 0.50% MgO is equivalent to addition of 0.72% $Mg(OH)_2$. MgO is not more effective but the addition of more alkali was effective. While the data seems to indicate that that $Mg(OH)_2$ addition was less than optimal, this is due to the difference in molecular weights of MgO and $Mg(OH)_2$. Since the brightness was higher, it naturally follows that the residual addition was less than optimal. Since the brightness was higher, it naturally follows that the residual peroxide is lower. It must be remember that in all of these cases there is an excess of peroxide and deficiency of alkali.

The L-a-b numbers are the HunterLab color numbers described previously.

TABLE 3

Bleaching experiment results for TMP#2 pulp at 10% pulp consistency

| | | Time, hours | DTPA | $Na_2SiO_3$ | NaOH | $H_2O_2$ | $Mg(OH)_2$ | Initial pH | Final pH | Residual $H_2O_2$(g/l) | Brightness % ISO | L | a | b |
|---|---|---|---|---|---|---|---|---|---|---|---|---|---|---|
| Brownstock | | | | | | | | | | | 60.9 | 87.0 | 0.53 | 12.52 |
| Chelation | Blank | | | | | | | | | | 60.5 | 86.8 | 0.50 | 12.56 |
| | DTPA | | 0.3% | | | | | | | | 60.6 | 86.9 | 0.50 | 12.60 |
| | $Mg(OH)_2$ | | $Mg(OH)_2$ = 0.363% | | | | | | | | 56.1 | 83.6 | 0.42 | 12.15 |
| Base Case | | 2 | 0.3% | 3% | 1.44% | 2.0% | 0% | 10.6 | 8.1 | 0.714 | 69.8 | 91.9 | −1.40 | 11.89 |
| | | 5 | 0.3% | 3% | 1.44% | 2.0% | 0% | 10.7 | 7.3 | 0.646 | 70.3 | 92.4 | −1.59 | 12.13 |
| Particle Size | 0.415 micron | 2 | 0.2%, 0.1% | 0 | 0 | 2.0% | 0.50% | 6.0 | 6.4 | 1.673 | 68.6 | 91.3 | −1.07 | 12.01 |
| | 3.101 micron | 2 | 0.2%, 0.1% | 0 | 0 | 2.0% | 0.50% | 5.3 | 6.5 | 1.659 | 68.7 | 91.3 | −1.13 | 11.95 |
| | 0.650 micron | 2 | 0.2%, 0.1% | 0 | 0 | 2.0% | 0.50% | 5.7 | 6.5 | 1.673 | 68.7 | 91.3 | −1.05 | 11.91 |
| Varying Chelant in chelation and Peroxide stage | | 5 | 0.15%, 0.05% | 0 | 0 | 2.0% | 0.50% | 6.1 | 6.1 | 1.408 | 69.5 | 92.0 | −1.19 | 12.25 |
| | | 5 | 0.10%, 0.05% | 0 | 0 | 2.0% | 0.50% | 5.7 | 6.2 | 1.102 | 69.0 | 91.6 | 1.14 | 12.2 |
| | | 5 | No Q, 0.0% | 0 | 0 | 2.0% | 0.50% | 6.1 | 6.7 | 0.218 | 64.4 | 89.1 | −0.48 | 12.52 |
| | | 5 | No Q, 0.1% | 0 | 0 | 2.0% | 0.50% | 5.5 | 6.2 | 0.646 | 67.3 | 90.8 | −0.9 | 12.44 |
| | | 5 | 0.2%, 0.0% | 0 | 0 | 2.0% | 0.50% | 6.3 | 6.1 | 1.299 | 69.4 | 91.9 | −1.29 | 12.26 |
| MgO | | 2 | 0.2%, 0.1% | 0 | 0 | 2.0% | 0.50% | 7.4 | 6.4 | 1.394 | 70.1 | 92.0 | −1.33 | 11.83 |
| | | 5 | 0.15%, 0.05% | 0 | 0 | 2.0% | 0.50% | 7.6 | 6.3 | 1.013 | 70.0 | 92.13 | −1.26 | 12.04 |

TABLE 4

Comparison of Beaching Results for Northern TMP #1 and TMP #2 (10% Consistency)

| | Sample ID | DTPA | $Na_2SiO_3$ | NaOH | $H_2O_2$ | $Mg(OH)_2$ | Initial pH | Final pH | Residual $H_2O_2$(g/l) | Brightness % ISO | Color L | a | b |
|---|---|---|---|---|---|---|---|---|---|---|---|---|---|
| TMP #2 | U-Chelated | | | | | | | | | 60.92 | 86.98 | 0.53 | 12.52 |
| Data | Control | 0.3% | 3% | 1.44% | 2.00% | 0 | 10.63 | 8.05 | 0.714 | 69.80 | 91.91 | −1.40 | 11.89 |
| | 3.101 micron | 0.2%, 0.1% | 0 | 0 | 2.00% | 0.50% | 5.28 | 6.50 | 1.659 | 68.73 | 91.31 | −1.13 | 11.95 |
| | 0.650 micron | 0.2%, 0.1% | 0 | 0 | 2.00% | 0.50% | 5.67 | 6.48 | 1.673 | 68.73 | 91.28 | −1.05 | 11.91 |
| | 0.415 micron | 0.2%, 0.1% | 0 | 0 | 2.00% | 0.50% | 6.00 | 6.42 | 1.673 | 68.63 | 91.28 | −1.07 | 12.01 |
| | MagChem 35 MgO | 0.2%, 0.1% | 0 | 0 | 2.00% | 0.50% | 7.38 | 6.40 | 1.394 | 70.06 | 91.98 | −1.33 | 11.83 |
| TMP #1 | U-1-1 | | | | | | | | | 62.04 | 87.85 | 0.31 | 12.83 |
| Data | Control | 0.3% | 3% | 1.56% | 2.0% | 0.00% | 11.06 | 8.00 | 0.394 | 72.46 | 92.78 | −2.15 | 11.13 |
| | 3.101 | 0.2%, 0.1% | 0 | 0 | 2.0% | 0.50% | 5.71 | 7.09 | 0.891 | 69.77 | 91.71 | −1.060 | 11.70 |
| | 0.650 | 0.2%, 0.1% | 0 | 0 | 2.0% | 0.50% | 6.28 | 7.05 | 1.122 | 70.29 | 92.03 | −1.150 | 11.74 |
| | 0.603 | 0.2%, 0.1% | 0 | 0 | 2.0% | 0.50% | 6.31 | 6.99 | 1.021 | 70.31 | 92.04 | −1.110 | 11.70 |

TABLE 4-continued

Comparison of Beaching Results for Northern TMP #1 and TMP #2 (10% Consistency)

| Sample | | | | | | Initial | Final | Residual | Brightness | Color | | |
|---|---|---|---|---|---|---|---|---|---|---|---|---|
| ID | DTPA | $Na_2SiO_3$ | NaOH | $H_2O_2$ | $Mg(OH)_2$ | pH | pH | $H_2O_2$(g/l) | % ISO | L | a | b |
| 0.415 | 0.2%, 0.1% | 0 | 0 | 2.0% | 0.50% | 6.50 | 7.28 | 1.006 | 70.26 | 91.92 | −1.35 | 11.66 |
| Natural $Mg(OH)_2$ | 0.2%, 0.1% | 0 | 0 | 2.0% | 0.50% | 4.92 | 7.10 | 0.394 | 67.16 | 90.32 | −0.700 | 11.89 |
| MagChem 35 MgO | 0.2%, 0.1% | 0 | 0 | 2.0% | 0.50% | 7.78 | 6.69 | 0.510 | 71.13 | 92.53 | −1.320 | 11.73 |

Hydrogen Peroxide Bleaching of TMP Pulps Using $Mg(OH)_2$.

Hydrogen Peroxide Bleaching of TMP Pulps Using $Mg(OH)_2$: Optimization Experiments Experiments were done to screen various methods of using $Mg(OH)_2$ in peroxide bleaching of TMP pulp to uncover optimized bleaching conditions. Pulps from two mills were used. These experiments further demonstrated that mill condition brightness values could be approached by peroxide bleaching using $Mg(OH)_2$, without the use of caustic or silicate in the bleaching liquor. In many experiments, the residual peroxide content was substantial, and brightness could perhaps be increased if the residual could be utilized.

Procedures and Experiments

The following experiments were done on an unchelated pulp sample using a 3.1 micron $Mg(OH)_2$ sample supplied by Martin Marietta Magnesia, Baltimore, Md. Bleaching procedures were outlined above. Bleaching conditions are found in the data Tables 5–11, below.

Bleaching experiments were done using a chelation stage followed by a hydrogen peroxide stage, both at 10% consistency (where consistency is wt % pulp in slurry), and the pulp was then washed and tested. Procedures were modified slightly from the first phase of the work. The chelation stage was done on one day, and the peroxide stage on the following day, to accommodate personnel scheduling (as opposed to both stages being done on the same day). The pulp washing procedure was modified to always use the same amount of water.

Control

Mill conditions (10% consistency, 70° C., chelation, 0.2% hydrosulfite, 0.3% DTPA, 30 min.; peroxide stage, 0.3% silicate, 1.5% NaOH, 2% peroxide, 5 hours)

Split $Mg(OH)_2$ Addition

Split $Mg(OH)_2$ experiments were conducted to determine whether additional $Mg(OH)_2$, after the initial dose at the beginning of the peroxide stage, helps to decompose some of the remaining peroxide residual, so the bleaching reaction can continue to target brightness without additional peroxide.

Experiments were also conducted to determine whether recycling of residual peroxide can increase brightness gain.

Split $Mg(OH)_2$ Addition Experiments

The results from the split addition $Mg(OH)_2$ experiments (starting the bleaching with 0.1% DTPA, 2% peroxide, 0.5% $Mg(OH)_2$, then after 2 hours adding additional $Mg(OH)_2$) are found in FIGS. 9–11, in which the $Mg(OH)_2$ charge is shown along the abscissa and brightness, residual peroxide and initial and final pH are shown along the ordinate of each figure, respectively.

The mill control conditions were reached with a 0.5% $Mg(OH)_2$ in the beginning, and an additional 0.25% $Mg(OH)_2$ during the reaction time. Brightness increased with increasing dosage of $Mg(OH)_2$ added during the reaction, and residual peroxide decreased. There was still residual available with a 0.5% $Mg(OH)_2$ additional dose.

Experiments were conducted to determine the effects of Fresh Peroxide+Filtrate Peroxide Experiments on bleaching results.

FIGS. 12–14 show results of these experiments, using the pulp sample from Phase 1 work, of substituting residual peroxide for fresh. FIG. 12 shows how brightness varies with peroxide charge and FIGS. 13–14 show how residual peroxide and initial and final pH are affected by peroxide charge. They show that the substitution worked, as long as the proper amount of $Mg(OH)_2$ was added. As can be seen in FIG. 12, at a DTPA concentration of 0.2% and a $Mg(OH)_2$ concentration of 0.5%, a ratio of 1.2% fresh to 0.8% residual hydrogen peroxide (based on pulp mass) gave an ISO brightness value of 69.1%, which is close to the result produced by 2% fresh peroxide, which yielded an ISO brightness value of 69.3%.

For the following set of experiments, fresh peroxide plus additional peroxide from filtrate (residual) from previous bleaching experiments was used in the bleaching liquor. Several experiments were done with fresh peroxide only, and the filtrate from these experiments was used in filtrate recycling experiments.

For the 1.5% fresh peroxide plus residual peroxide, the brightness increases with increasing filtrate peroxide, about a 1.5 brightness point increase with 1% filtrate peroxide added.

One difference to note in the experiments is the lower pH. In the control, mill condition runs have very similar initial and final pH values to the previous work in Phase 1 on the last pulp sample, about 10.7 initial to 7.3 final. However, the $Mg(OH)_2$ experiments show a difference in the initial pH values. The Phase 1 experiments showed a 5.5 to 6.3 pH range for the initial, and a 6.2 to 6.5 range for the final pH, while the current experiments show a 4.7 to 5.1 range for initial, and a 5.8 to 6.3 range for the final pH. The current experiments used hydrosulfite in the chelation stage, which may contribute to lower pH. This set of experiments used a new sample of $Mg(OH)_2$ which had a 3.1 micron particle size. In the Phase 1 work, this size gave a lower initial pH, but did not affect brightness results FIGS. 15–17 show the ISO brightness, residual peroxide and pH results for a second set of experiments in which at least a portion of the hydrogen peroxide in the bleaching tower is introduced via a recycled filtrate. FIGS. 18–20 show the ISO brightness, residual peroxide and pH results for experiments in which the filtrate is repeatedly recycled.

Handsheet Strength Values

Handsheets were made from select pulps, to compare strength values for the different pulping conditions. Two control pulps were chosen, and then pulps from various $Mg(OH)_2$ experiments that had similar brightness values to the control pulps.

Table 5 shows the pulp strength testing of pulps from various experiments, and FIG. 28 shows the pulp strength. Little difference is seen between any of the pulps. Table 6 shows the data for brightness reversion characteristics for $Mg(OH)_2$ and MgO.

TABLE 5

Handsheet Strength Data for Bleached Northern TMP

| Experiment Brightness | Control 70.51 | Control 70.54 | Split $Mg(OH)_2$ Addition 70.55 | Recycle Residual Peroxide (2% fresh) 70.06 | Response Curve for $Mg(OH)_2$ 70.49 |
|---|---|---|---|---|---|
| Caliper (mm) | 0.141 | 0.141 | 0.146 | 0.153 | 0.154 |
| Sheet Density ($g/cm^3$) | 0.423 | 0.414 | 0.395 | 0.391 | 0.409 |
| Bulk ($cm^3/g$) | 2.37 | 2.42 | 2.53 | 2.56 | 2.45 |
| grammage (gsm, OD) | 59.6 | 58.4 | 57.7 | 59.8 | 62.9 |
| load (lbf) | 8.74 | 8.46 | 8.35 | 7.79 | 8.16 |
| stretch % | 2.61 | 2.59 | 2.53 | 2.39 | 2.72 |
| integral (lbf-in) | 0.62 | 0.62 | 0.60 | 0.51 | 0.62 |
| Tensile Strength (kN/m) | 2.59 | 2.51 | 2.48 | 2.31 | 2.42 |
| Tensile Index (Nm/g) | 39.3 | 38.9 | 38.9 | 35.0 | 34.8 |
| Breaking Length (km) | 4.01 | 3.97 | 3.96 | 3.56 | 3.55 |
| TEA ($J/m^2$) | 46.80 | 46.37 | 44.99 | 38.68 | 46.83 |
| Tear Index ($mNm^2/g$) | 7.97 | 8.15 | 7.68 | 7.67 | 7.89 |

TABLE 5-continued

Handsheet Strength Data for Bleached Northern TMP

| Experiment Brightness | Control 70.51 | Control 70.54 | Split $Mg(OH)_2$ Addition 70.55 | Recycle Residual Peroxide (2% fresh) 70.06 | Response Curve for $Mg(OH)_2$ 70.49 |
|---|---|---|---|---|---|
| Burst Index (kPa.m2/g) | 2.41 | 2.34 | 2.29 | 2.21 | 2.13 |
| Wet Z-span Breaking Length (km) | 6.3 | 6.3 | 6.3 | 6.4 | 5.8 |

TABLE 6

Brightness reversion for $Mg(OH)_2$ and MgO Bleached Northern TMP

| | Brightness, ISO % | | Brightness | |
|---|---|---|---|---|
| | Initial | After aging | Reversion | % |
| Control 2 hr (D2) | 70.8 | 66.7 | 4.1 | 5.8 |
| $Mg(OH)_2$ 2 hr (F3) | 69.2 | 64.8 | 4.4 | 6.4 |
| $MgO_2$ hr | 70.5 | 65.9 | 4.6 | 6.5 |
| Control 5 hr | 70.0 | 66.7 | 3.3 | 4.7 |
| $Mg(OH)_2$ 5 hr (f-1) | 68.4 | 64.7 | 3.7 | 5.4 |
| MgO 2 hr | 69.4 | 66.6 | 2.8 | 4.0 |

TABLE 7

COD and Anionic Trash Content

| | Mill bleached pulp | $P_{NaOH}$ pulp | $P_{Mg(OH)_2}$ pulp |
|---|---|---|---|
| COD (kg/ton) | — | 56.7 | 46.3 |
| Cationic charge demand (mef/kg) | 16.5 | 20.2 | 12.9 |

TABLE 8

Chemical and physical analysis of magnesium hydroxide samples.

| Sample | Median Particle Size (μm) | Surface Area ($m^2/g$) | % Solids | $Mg(OH)_2$[1] (%) | CaO (%) | $SiO_2$ (%) | $Fe_2O_3$ (%) | $Al_2O_3$ (%) | $SO_3$ (%) | Cl (%) | Mn (ppm) | LOI (%) |
|---|---|---|---|---|---|---|---|---|---|---|---|---|
| P277-261-1 | 2.50 | 10.4 | 59.8 | 98.71 | 0.67 | 0.19 | 0.09 | 0.06 | 0.04 | 0.23 | 100.0 | ~31.0 |
| P277-261-2 | 1.52 | 11.4 | 59.8 | 98.72 | 0.67 | 0.19 | 0.09 | 0.06 | 0.03 | 0.23 | 106.0 | ~31.0 |
| P277-261-3 | 0.65 | 13.6 | 59.8 | 98.74 | 0.67 | 0.19 | 0.09 | 0.06 | 0.01 | 0.23 | 112.0 | ~31.0 |
| P277-262-1 | 0.415 | 22.3 | 53.4 | 98.74 | 0.64 | 0.19 | 0.10 | 0.06 | 0.01 | 0.25 | ~100.0 | ~31.0 |
| P277-262-2 | 0.603 | 18.4 | 56.4 | 98.73 | 0.65 | 0.19 | 0.09 | 0.06 | 0.01 | 0.26 | ~100.0 | ~31.0 |
| P277-262-3 | 1.461 | 16.8 | 56.4 | 98.75 | 0.64 | 0.19 | 0.09 | 0.06 | 0.01 | 0.25 | ~100.0 | ~31.0 |
| P277-262-4 | 3.101 | 15.5 | 56.4 | 98.74 | 0.64 | 0.19 | 0.09 | 0.06 | 0.01 | 0.26 | ~100.0 | ~31.0 |
| MgO | 3.80 | 30.0 | N/a | 98.51 (MgO basis) | 0.70 | 0.28 | 0.12 | 0.09 | 0.01 | 0.28 | 108.0 | 1.76 |
| Natural MgO | 8.09 | 28.8 | N/a | 97.30 (MgO basis) | 1.72 | 0.31 | 0.53 | 0.12 | 0.31 | 0.019 | 194 | 2.68 |

[1]$Mg(OH)_2$ % by difference (dry basis).

TABLE 9

Bleaching Results - Control and Split $Mg(OH)_2$ Addition

| | exp. Date | time, hours | $Na_2SiO_3$ % | NaOH % | Q stage* DTPA % | P stage DTPA % | total DTPA % | $H_2O_2$ fresh % | $H_2O_2$ filtrate % | total $H_2O_2$ % | $Mg(OH)_2$ % | $H_2O_2$: $Mg(OH)_2$ | P stage DTPA: $Mg(OH)_2$ |
|---|---|---|---|---|---|---|---|---|---|---|---|---|---|
| Brownstock | 1/11 | | | | | | | | | 0 | | | |
| Control | | | | | | | | | | | | | |
| Q & P stages consecutive days | 5/2 | 5 | 3 | 1.5 | 0.3 | | 0.3 | 2.0 | | 2.0 | | | |
| | | 5 | 3 | 1.5 | 0.3 | | 0.3 | 2.0 | | 2.0 | | | |
| | | 5 | 3 | 1.5 | 0.3 | | 0.3 | 2.0 | | 2.0 | | | |
| | | 5 | 3 | 1.5 | 0.3 | | 0.3 | 2.0 | | 2.0 | | | |
| | | 5 | 3 | 1.5 | 0.3 | | 0.3 | 2.0 | | 2.0 | | | |
| Q & P stages same days | | 5 | 3 | 1.5 | 0.3 | | 0.3 | 2.0 | | 2.0 | | | |
| AVERAGE | | 5 | 3 | 1.5 | 0.3 | | 0.3 | 2.0 | | 2.0 | | | |
| Split $Mg(OH)_2$ addition | | | | | | | | | | | | | |
| Q & P stages consecutive days | | 2/3 | | | 0.2 | 0.1 | 0.30 | 2.0 | | 2.0 | 0.5/0 | | 0.20 |
| | | 2/3 | | | 0.2 | 0.1 | 0.30 | 2.0 | | 2.0 | 0.5/0.1 | | 0.17 |
| | | 2/3 | | | 0.2 | 0.1 | 0.30 | 2.0 | | 2.0 | 0.5/0.25 | | 0.13 |
| | | 2/3 | | | 0.2 | 0.1 | 0.30 | 2.0 | | 2.0 | 0.5/0.5 | | 0.10 |
| Q & P stages same days | | 2/3 | | | 0.2 | 0.1 | 0.30 | 2.0 | | 2.0 | 0.5/0.25 | | 0.13 |

| | Initial pH | Final pH | Residual $H_2O_2$ (g/l) | % $H_2O_2$ consumed | % $H_2O_2$/ point br gain | Bright-ness % ISO | L | a | b | COD (mg/l) |
|---|---|---|---|---|---|---|---|---|---|---|
| Brownstock | | | | | | 63.53 | 88.7 | 0.17 | 12.62 | |
| Control | | | | | | | | | | |
| Q & P stages consecutive days | 10.71 | 7.59 | 0.65 | 71 | 10.1 | 70.51 | 92.5 | -1.51 | 12.20 | 7400 |
| | 10.76 | 7.32 | 0.59 | 73 | 10.4 | 70.54 | 92.6 | -1.61 | 12.25 | 7410 |
| | 10.74 | 7.21 | 0.63 | 72 | 10.1 | 70.58 | 92.7 | -1.48 | 12.46 | 7320 |
| | 10.72 | 7.54 | 0.65 | 71 | 11.2 | 69.86 | 92.2 | -1.43 | 12.31 | |
| | 10.77 | 7.40 | 0.71 | 68 | 9.4 | 70.76 | 92.6 | -1.75 | 12.15 | 7220 |
| Q & P stages same days | 10.76 | 7.30 | 0.63 | 72 | 10.4 | 70.39 | 92.6 | -1.47 | 12.35 | 7370 |
| AVERAGE | 10.74 | 7.39 | 0.64 | 71 | 10.3 | 70.44 | 92.5 | -1.54 | 12.29 | 7344 |
| Split $Mg(OH)_2$ addition | | | | | | | | | | |
| Q & P stages consecutive days | 4.86 | 5.86 | 1.59 | 28 | 4.3 | 69.92 | 92.1 | -1.22 | 12.16 | 4430 |
| | 4.66 | 6.03 | 1.48 | 33 | 5.2 | 69.81 | 92.1 | -1.12 | 12.27 | 4100 |
| | 4.86 | 6.35 | 1.28 | 42 | 6.0 | 70.55 | 92.7 | -1.59 | 12.43 | 4350 |
| | 4.83 | 6.78 | 1.01 | 54 | 7.2 | 71.04 | 92.9 | -1.73 | 12.28 | 5060 |
| Q & P stages same days | 5.03 | 6.41 | 1.31 | 41 | 5.9 | 70.47 | 92.6 | -1.31 | 12.37 | 4300 |

TABLE 10

Bleaching Results - Chelant Ratios - Northern TMP.

| | exp. Date | time, hours | $Na_2SiO_3$ % | NaOH % | Q stage* DTPA % | P stage DTPA % | total DTPA % | $H_2O_2$ fresh % | $H_2O_2$ filtrate % | total $H_2O_2$ % | $Mg(OH)_2$ % | $H_2O_2$: $Mg(OH)_2$ | P stage DTPA: $Mg(OH)_2$ |
|---|---|---|---|---|---|---|---|---|---|---|---|---|---|
| Brownstock | 1/11 | | | | | | | | | 0 | | | |
| response curve for $Mg(OH)_2$ | 4/20 | 5*(a) | | | 0.2 | 0.1 | 0.30 | 2.0 | | 2.0 | 0.5 | 4.0 | 0.2 |
| | | 5(b) | | | 0.2 | 0.1 | 0.30 | 2.0 | | 2.0 | 1.0 | 2.0 | 0.10 |
| | | 5 | | | 0.2 | 0.1 | 0.30 | 2.0 | | 2.0 | 1.5 | 1.3 | 0.07 |
| changing ratio of $H_2O_2$ to $Mg(OH)_2$ | | 5 | | | 0.2 | 0.1 | 0.30 | 2.0 | | 2.0 | 2.0 | 1.0 | 0.05 |
| | | 5 | | | 0.2 | 0.1 | 0.30 | 2.0 | | 2.0 | 2.5 | 0.8 | 0.04 |
| | | 5 | | | 0.2 | 0.1 | 0.30 | 2.0 | | 2.0 | 3.0 | 0.7 | 0.03 |
| Optimize Chelant Dosage | | | | | | | | | | | | | |
| constant DTPA: $Mg(OH)_2$ ratio | 4/27 | 5*(b) | | | 0.2 | 0.1 | 0.30 | 2.0 | | 2.0 | 1.0 | 2.0 | 0.10 |
| | | 5 | | | 0.2 | 0.15 | 0.35 | 2.0 | | 2.0 | 1.5 | 1.33 | 0.10 |
| | | 5 | | | 0.2 | 0.20 | 0.40 | 2.0 | | 2.0 | 2.0 | 1.00 | 0.10 |
| | | 5 | | | 0.2 | 0.25 | 0.45 | 2.0 | | 2.0 | 2.5 | 0.80 | 0.10 |
| | | 5 | | | 0.2 | 0.30 | 0.50 | 2.0 | | 2.0 | 3.0 | 0.67 | 0.10 |
| differing DTPA: $Mg(OH)_2$ ratio | 5/2 | 5 | | | 0.2 | 0.2 | 0.05 | 2.0 | | 2.0 | 1.0 | 2.0 | 0.05 |
| | | 5*(b) | | | 0.2 | 0.2 | 0.1 | 2.0 | | 2.0 | 1.0 | 2.0 | 0.10 |
| | | 5 | | | 0.2 | 0.2 | 0.15 | 2.0 | | 2.0 | 1.0 | 2.0 | 0.15 |
| | | 5 | | | 0.2 | 0.2 | 0.20 | 2.0 | | 2.0 | 1.0 | 2.0 | 0.20 |
| | | 5 | | | 0.2 | 0.2 | 0.25 | 2.0 | | 2.0 | 1.0 | 2.0 | 0.25 |

| | Initial pH | Final pH | Residual $H_2O_2$ (g/l) | % $H_2O_2$ consumed | % $H_2O_2$/ point br gain | Bright-ness % ISO | L | a | b | COD (mg/l) |
|---|---|---|---|---|---|---|---|---|---|---|
| Brownstock | | | | | | 63.53 | 88.7 | 0.17 | 12.62 | |
| response curve for $Mg(OH)_2$ | 4.90 | 5.86 | 1.68 | 24 | 4.3 | 68.99 | 91.9 | -1.22 | 12.52 | 3993 |
| | 5.74 | 6.69 | 1.10 | 50 | 6.4 | 71.37 | 73.0 | -1.77 | 12.15 | 4490 |
| | 5.90 | 7.37 | 0.59 | 73 | 10.5 | 70.49 | 92.6 | -1.76 | 12.47 | 5110 |
| changing ratio of $H_2O_2$ to $Mg(OH)_2$ | 6.10 | 7.81 | 0.32 | 85 | 15.1 | 69.18 | 91.9 | -1.71 | 12.69 | 5270 |
| | 6.32 | 7.98 | 0.24 | 89 | 18.0 | 68.48 | 91.6 | -1.72 | 13.00 | 5280 |
| | 6.60 | 8.10 | 0.18 | 92 | 21.5 | 67.80 | 91.4 | -1.79 | 13.38 | 5260 |
| Optimize Chelant Dosage | | | | | | | | | | |
| constant DTPA: $Mg(OH)_2$ ratio | 5.74 | 6.69 | 1.10 | 50 | 6.4 | 71.37 | 93.0 | -1.77 | 12.15 | 4490 |
| | 5.26 | 7.35 | 0.60 | 73 | 10.6 | 70.42 | 92.8 | -1.76 | 12.55 | 5190 |
| | 5.74 | 8.02 | 0.37 | 83 | 13.5 | 69.67 | 92.3 | -1.76 | 12.47 | 5380 |
| | 5.90 | 8.19 | 0.29 | 87 | 16.2 | 68.89 | 92.0 | -1.70 | 12.75 | 5400 |
| | 6.10 | 8.24 | 0.26 | 88 | 17.1 | 68.68 | 92.0 | -1.77 | 12.85 | 5870 |
| differing DTPA: $Mg(OH)_2$ ratio | 5.32 | 6.55 | 1.08 | 51 | 6.7 | 71.09 | 92.8 | -1.79 | 21.17 | 4520 |
| | 5.74 | 6.69 | 1.10 | 50 | 6.4 | 71.37 | 93.0 | -1.77 | 12.15 | 4490 |
| | 5.95 | 6.63 | 1.14 | 48 | 6.1 | 71.38 | 93.1 | -1.91 | 12.33 | 4690 |
| | 6.08 | 6.67 | 1.13 | 49 | 6.3 | 71.29 | 93.1 | -1.95 | 12.42 | 4780 |
| | 6.05 | 6.63 | 1.14 | 48 | 6.3 | 71.22 | 93.1 | -1.90 | 12.45 | 4850 |

All experiments at 10% consistency

*0.2% hydrosulfite in all Q stages (a) or (b)data is repeated elsewhere in table

*(a) or (b)data repeated from elsewhere in table

TABLE 11

Data for 2.5% peroxide, and high consistency - Northern Groundwood

| | ID | time, hours | $Na_2SiO_3$ % | NaOH % | Q stage DTPA % | total DTPA % | $H_2O_2$ fresh % | $Mg(OH)_2$ % | Initial pH | Final pH | Residual $H_2O_2$ (g/l) | % $H_2O_2$ consumed | % $H_2O_2$/ point br gain | Bright-ness % ISO | Brightness % ISO after pH adj to 5.7 | COD (mg/l) | Con-duc-tivity (ms/m) |
|---|---|---|---|---|---|---|---|---|---|---|---|---|---|---|---|---|---|
| Brownstock | | | | | | | | | | | | | | 59.5 | 60.3 | | |
| | | | | | | | | 2.5% peroxide | | | | | | | | | |
| DTPA in chelation stage (Qy) | | | | | | | | | | | | | | | | | |
| Control | | | | | | | | | | | | | | | | | |
| Q-P | 9c-1 | 2 | 3 | 2.5 | 0.5 | 0.5 | 2.5 | | 11.0 | 8.8 | 0.50 | 82 | 5.7 | 73.9 | 75.2 | 7990 | 618 |
| | 9c-3 | 2 | 3 | 2.5 | 0.5 | 0.5 | 2.5 | | 11.1 | 8.7 | 0.50 | 82 | 5.9 | 73.5 | 75.2 | 8160 | 644 |
| | 9c-4 | 2 | 3 | 2.5 | 0.5 | 0.5 | 2.5 | | 11.1 | 8.8 | 0.50 | 82 | 5.6 | 74.6 | 74.6 | | |
| average | | | | | | | | | 11.1 | 8.8 | 0.50 | 82 | 5.7 | 73.9 | 75.0 | | |
| Q-P-Y | 9c-2 | 2 | 3 | 2.5 | 0.5 | 0.5 | 2.5 | | 6.2 | 6.2 | | | | 76.4 | 77.1 | | |
| peroxide/$Mg(OH)_2$ | | | | | | | | | | | | | | | | | |
| $Mg(OH)_2$ | 9m-1 | 2 | | | 0.5 | 0.5 | 2.5 | 0.5 | 7.8 | 7.3 | 1.99 | 28 | 2.6 | 70.6 | 71.9 | 3280 | 176 |
| Response | 9m-2 | 2 | | | 0.5 | 0.5 | 2.5 | 1.0 | 8.0 | 7.6 | 1.76 | 37 | 3.2 | 71.1 | 72.6 | | |
| Curve | 9m-3 | 2 | | | 0.5 | 0.5 | 2.5 | 1.5 | 8.1 | 7.8 | 1.56 | 44 | 3.8 | 71.0 | 72.4 | | |
| Q-P | 9m-4 | 2 | | | 0.5 | 0.5 | 2.5 | 2.0 | 8.2 | 8.0 | 1.41 | 49 | 4.3 | 70.9 | 72.4 | | |
| Q-P-Y(1) | 9m-2h | 2 | | | 0.5 | 0.5 | 2.5 | 1.0 | 7.2 | 7.1 | | | | 71.9 | 73.6 | 1380 | 466 |
| | 9m-3h | 2 | | | 0.5 | 0.5 | 2.5 | 1.5 | 7.1 | 6.8 | | | | 73.3 | 74.4 | | |
| split | split-1 | 2/2 | | | 0.5 | 0.5 | 2.5 | 1.0/0.6 | 8.0 | 7.7 | 1.28 | 54 | 4.2 | 72.3 | 73.1 | | |
| $Mg(OH)_2$ | split-2 | 2/2 | | | 0.5 | 0.5 | 2.5 | 1.0/0.9 | 8.1 | 7.8 | 0.97 | 65 | 5.2 | 72.1 | 72.9 | | |
| addition | split-1 | 2/2 | | | 0.5 | 0.5 | 2.5 | 1.5/0.8 | 8.2 | 7.9 | 0.97 | 65 | 5.2 | 72.1 | 72.9 | | |
| Q-P | split-2 | 2/2 | | | 0.5 | 0.5 | 2.5 | 1.5/1.2 | 8.2 | 8.0 | 0.92 | 67 | 5.4 | 72.0 | 72.4 | | |
| Silicate | | 2* | 0 | | 0.5 | 0.5 | 2.5 | 1.0 | 8.0 | 7.6 | 1.76 | 37 | 3.2 | 71.1 | 72.6 | | |
| Response | | 2 | 1 | | 0.5 | 0.5 | 2.5 | 1.0 | 9.2 | 7.9 | 1.61 | 42 | 3.5 | 71.7 | 72.1 | | |
| Curve | | 2 | 2 | | 0.5 | 0.5 | 2.5 | 1.0 | 9.6 | 8.0 | 1.47 | 47 | 3.8 | 71.9 | 72.3 | | |
| Q-P | | 2 | 3 | | 0.5 | 0.5 | 2.5 | 1.0 | 9.8 | 8.2 | 1.31 | 53 | 4.2 | 72.1 | 72.8 | | |
| Hydrosulfite and DTPA in Chelation stage (Qy) | | | | | | | | | | | | | | | | | |
| Control | | | | | | | | | | | | | | | | | |
| Qy-P | 9c-4 | 2 | 3 | 2.5 | 0.5 | 0.5 | 2.5 | | 11.1 | 8.8 | 0.50 | 82 | 5.6 | 74.2 | 74.6 | | |
| Qy-P-Y | 9c-4h | 2 | 3 | 2.5 | 0.5 | 0.5 | 2.5 | | 6.3 | 6.1 | | | | 76.5 | 76.8 | 3330 | 388 |
| peroxide/$Mg(OH)_2$ | | | | | | | | | | | | | | | | | |
| Qy-P | 9h-1 | 2 | | | 0.5 | 0.5 | 2.5 | 1.0 | 7.5 | 7.6 | 1.79 | 36 | 2.9 | 71.7 | 72.5 | 3160 | 184 |
| | 9h-2 | 2 | | | 0.5 | 0.5 | 2.5 | 1.5 | 7.8 | 7.9 | 1.65 | 41 | 3.3 | 71.8 | 71.7 | | |
| Qy-P-Y | 9p-1h | 2 | | | 0.5 | 0.5 | 2.5 | 1.0 | 6.4 | 6.2 | | | | 74.1 | 75.1 | 2000 | 472 |
| | 9p-2h | 2 | | | 0.5 | 0.5 | 2.5 | 1.5 | 6.4 | 6.3 | | | | 73.7 | 74.5 | | |

Q (chelation stage): 0.5% DTPA, 10% consistency, 70 C., 30 min
Qy (chelation with hydrosulfite): add 0.2% hydrosul
P (peroxide stage): 10% consistency, 70 C., 2 hours, various chemistry
Y (hydrosulfite stage): 4% consistency, 0.7% hydrosulfite, 60 C., 30 minutes

TABLE 12

Data for 3% peroxide, and high consistency bleaching - Northern Groundwood

| | ID | time, hours | $Na_2iO_3$ % | NaOH % | Q stage DTPA % | total DTPA % | H2O2 fresh % | $Mg(OH)_2$ % |
|---|---|---|---|---|---|---|---|---|
| Brownstock | | | | | | | | |
| Hydrosulfite and DTPA in Chelation stage (Qy) | | | | | | | | |
| 3% peroxide | | | | | | | | |
| Control | | | | | | | | |
| Qy-P<br>Qy-P-Y | 9c-5<br>9c-5h | 2<br>2 | 3<br>3 | 2.5<br>2.5 | 0.5<br>0.5 | 0.5<br>0.5 | 3.0<br>3.0 | |
| peroxide/$Mg(OH)_2$ | | | | | | | | |
| Qy-P | 9h-3<br>9h-4 | 2<br>2 | | | 0.5<br>0.5 | 0.5 | 3.0<br>3.0 | 1.2<br>1.8 |
| Qy-P-Y | 9p-3h<br>9p-4h | 2<br>2 | | | 0.5<br>0.5 | 0.5<br>0.5 | 3.0<br>3.0 | 1.2<br>1.8 |
| 23% consistency | | | | | | | | |
| control<br>Qy-P | 23c | 2.0 | 3.0 | 2.5 | 0.5 | 0.5 | 2.5 | |
| $H_2O_2/Mg(OH)_2$ | | | | | | | | |
| Qy-P | 23m-1<br>23m-2 | 2.0<br>2.0 | | | 0.5<br>0.5 | 0.5<br>0.5 | 2.5<br>2.5 | 1.0<br>1.5 |

| | ID | Initial pH | Final pH | Residual $H_2O_2$ (g/l) | % $H_2O_2$ con-sumed | % $H_2O_2$/point br gain | Bright-ness % ISO | Brightness % ISO after pH adj to 5.7 | COD (mg/l) | Conduc-tivity (ms/m) |
|---|---|---|---|---|---|---|---|---|---|---|
| Brownstock | | | | | | | 59.5 | 60.3 | | |
| Hydrosulfite and DTPA in Chelation stage (Qy) | | | | | | | | | | |
| 3% peroxide | | | | | | | | | | |
| Control | | | | | | | | | | |
| Qy-P<br>Qy-P-Y | 9c-5<br>9c-5h | 11.0<br>5.9 | 8.5<br>5.9 | 0.85 | 74 | 4.8 | 75.2<br>78.3 | 76.4<br>78.1 | 8790<br>3220 | 655<br>436 |
| peroxide/$Mg(OH)_2$ | | | | | | | | | | |
| Qy-P | 9h-3<br>9h-4 | 7.7<br>7.9 | 7.7<br>7.9 | 2.20<br>1.94 | 34<br>42 | 2.5<br>3.11 | 72.9<br>73.0 | 72.8<br>73.0 | 3350 | 201 |
| Qy-P-Y | 9p-3h<br>9p-4h | 6.7<br>6.0 | 6.5<br>5.9 | | | | 74.5<br>75.6 | 74.9<br>76.3 | 1330 | 539 |
| 23% consistency | | | | | | | | | | |
| control<br>Qy-P | 23c | n/a | 8.6 | 0.6 | 92 | 5.63 | 75.9 | 76.9 | 21870 | |
| $H_2O_2/Mg(OH)_2$ | | | | | | | | | | |
| Qy-P | 23m-1<br>23m-2 | n/a<br>n/a | 7.8<br>8.0 | 3.4<br>2.5 | 55<br>67 | 3.56<br>4.56 | 75.0<br>74.2 | 75.7<br>75.9 | 8150 | |

Q (chelation stage): 0.5% DTPA, 10% consistency, 70 C., 30 min
Qy (chelation with hydrosulfite): add 0.2% hydrosulfite
P (peroxide stage): 10% consistency, 70 C., 2 hours, various chemistry
Y (hydrosulfite stage): 4% consistency, 0.7% hydrosulfite, 60 C., 30 minutes
(1) pH without NaOH or hydrosulfite, after dilution to 4%: ~4.4 with 1.5% $Mg(OH)_2$; ~2.5 with 1% $Mg(OH)_2$
NaOH added to increase pH before Hydrosulfite stage
* data repeated from $Mg(OH)_2$ response curve FIGS. 21–24 show the ISO brightness, residual peroxide, and initial and final pH and COD values for experiments at various charges of $Mg(OH)_2$. FIGS. 25–27 show the ISO brightness, residual peroxide and initial and final pH values for experiments at ratios of chelant (DTPA) to $Mg(OH)_2$.

FIG. 28 shows bulk, breaking length, tear index, burst index and wet Z-span breaking length for paper produced from pulp subjected to control, split magnesium hydroxide, peroxide recycle and response curve for magnesium hydroxide conditions.

FIGS. 29–32 show the response curve of magnesium hydroxide. The H stage is a hydrosulfite reductive bleaching stage following the peroxide oxidative bleaching stage. These data are summarized in Tables 11 and 12 above.

FIGS. 33–37 show the response curve at medium pulp consistency at 2.5% and 3.0% hydrogen peroxide (based on pulp mass) for ISO brightness, peroxide residual and initial and final pH, respectively. These data are summarized in Tables 11 and 12 above.

FIGS. 38–40 show the effects of increased pulp consistency (i.e. increased pulp per unit volume) on ISO brightness, peroxide residual and initial and final pH. These data are summarized in Table 12 above.

The present invention possesses the following advantageous characteristics when compared with the prior art: The present invention reduces chemicals costs by eliminating caustic soda and sodium silicate, and by reducing DTPA and hydrogen peroxide usage. The present invention eliminates scaling and abrasion caused by sodium silicate. Allows bleaching to occur in the refiners. The present invention provides comparable brightness to caustic soda and sodium silicate bleaching at a significantly lower pH. The present invention provides for peroxide bleaching at a lower pH, which potentially reduces pH adjustment costs downstream. The present invention improves bulk properties of bleached pulp compared to caustic soda. The present invention provides a divalent magnesium, which improves the dewatering properties of pulp thus reducing the need for chemicals and defoamers. The divalent magnesium ion can also aid in better settling for wastewater treatment operations. The present invention reduces organics (BOD/COD) in the bleaching effluent for lower wastewater treatment costs. The present invention provides for recycling of high peroxide residuals for a reduction in peroxide usage. The present invention provides for improved pulp strength properties compared to caustic soda. Further, the invention provides reduced anionic trash and cationic demand for improved papermaking operations.

While the foregoing invention has been illustrated with reference to certain preferred embodiments, the person skilled in the art will recognize that other embodiments are embraced within the scope of the present invention.

We claim:

1. A process of making a bleached mechanical wood pulp comprising:

providing an aqueous slurry of mechanical wood pulp;

providing an aqueous bleaching mixture consisting essentially of water and hydrogen peroxide;

providing an aqueous magnesium hydroxide slurry consisting essentially of water and magnesium hydroxide;

combining together the aqueous slurry of mechanical wood pulp, the aqueous slurry consisting essentially of magnesium hydroxide and the aqueous bleaching mixture, to form a bleaching pulp mixture, the bleaching pulp mixture having a pH of from about 5.0 to 8.5, the initial ratio of magnesium hydroxide to hydrogen peroxide in said bleaching mixture being about 25 parts to about 75 parts of magnesium hydroxide to about 100 parts of hydrogen peroxide, and the magnesium hydroxide having an initial concentration in the bleaching pulp mixture of at least about 0.5 wt. %, based on pulp dry mass; and bleaching the bleaching pulp mixture consisting essentially of mechanical pulp, hydrogen peroxide, magnesium hydroxide and water for a time sufficient to produce bleached mechanical wood pulp, the bleached mechanical wood pulp having an ISO brightness of more than about 65%, and the magnesium hydroxide having a BET surface area of about 7 to about 15 $m^2/g$.

2. A process according to claim 1, wherein the bleaching pulp mixture is maintained for a reaction time of up to about 6 hours.

3. A process according to claim 1, wherein the bleaching pulp mixture is heated so as to be maintained at a temperature range of about 120° F. to about 210° F.

4. A process according to claim 1, wherein the hydrogen peroxide has an initial concentration in the bleaching pulp mixture of up to about 6 wt. %, based on pulp dry mass.

5. A process according to claim 4, wherein the hydrogen peroxide has an initial concentration of about 1 to about 6 wt. % based on pulp dry mass.

6. A process according to claim 1, wherein the magnesium hydroxide has an initial concentration in the bleaching pulp mixture of from about 0.5 wt. % up to about 5 wt. %, based on pulp dry mass.

7. A process according to claim 6, wherein the magnesium hydroxide has an initial concentration of from about 0.5 up to about 2 wt. % based on pulp dry mass in the bleaching pulp mixture.

8. A process according to claim 1, wherein the magnesium hydroxide contains less than about 250 ppm Mn, less than about 0.15 wt. % Fe, and less than about 250 ppm Cu, based on the equivalent mass of $Mg(OH)_2$.

9. A process according to claim 1, wherein the bleaching pulp mixture has a final pH of about 6.5 to about 8.0.

10. A process according to claim 1, wherein the mechanical wood pulp is selected from a group consisting of stone groundwood (SGW), pressurized stone groundwood (PSGW), refiner mechanical (RMP) and thermomechanical pulp (TMP).

11. A process according to claim 1, wherein bleaching pulp mixture is formed in the absence of sodium silicate.

12. A process according to claim 1, wherein bleaching pulp mixture is formed in the absence of sodium hydroxide.

13. A process of making a bleached mechanical wood pulp comprising:

providing an aqueous slurry of mechanical wood pulp;

providing an aqueous bleaching mixture consisting essentially of water, and hydrogen peroxide;

providing an aqueous magnesiun hydroxide slurry consisting essentially of water and magnesium hydroxide;

combining the aqueous slurry of mechanical wood pulp, the aqueous bleaching mixture, and the aqueous magnesium hydroxide-slurry to form a bleaching pulp mixture, the bleaching pulp mixture having a pH of from about 5.0 to 8.5, the initial ratio of magnesium hydroxide to hydrogen peroxide in said bleaching mixture being about 25 parts to about 75 parts of magnesium hydroxide per about 100 parts of hydrogen peroxide, and the magnesium hydroxide having an initial concentration in the bleaching pulp mixture of at least about 0.5 wt. %, based on pulp dry mass;

bleaching the bleaching pulp mixture consisting essentially of mechanical pulp, hydrogen peroxide, magnesium hydroxide and water for a time sufficient to produce bleached mechanical wood pulp, the bleached mechanical wood pulp having an ISO brightness of more than about 65%, and the magnesium hydroxide having a BET surface area of about 7 to about 15 $m^2/g$;

separating the bleached mechanical wood pulp from a filtrate comprising water and residual hydrogen peroxide; and recycling at least a portion of said filtrate as at least a portion of said bleaching pulp mixture.

14. A process according to claim 13, wherein the bleaching pulp mixture is maintained for a reaction time of up to about 6 hours.

15. A process according to claim 13, wherein the bleaching pulp mixture is heated so as to be maintained at a temperature range of about 120° F. to about 210° F.

16. A process according to claim 13, wherein the hydrogen peroxide has an initial concentration in the bleaching pulp mixture of up to about 6 wt. %, based on pulp dry mass.

17. A process according to claim 16, wherein the hydrogen peroxide has an initial concentration of about 1 to about 6 wt. % based on pulp dry mass.

18. A process according to claim 13, wherein the magnesium hydroxide has an initial concentration in the bleaching pulp mixture of from about 0.5 wt. % up to about 5 wt. %, based on pulp dry mass.

19. A process according to claim 18, wherein the magnesium hydroxide has an initial concentration of from about 0.5 to about 2 wt. % based on pulp dry mass.

20. A process according to claim 13, wherein the magnesium hydroxide contains less than about 250 ppm Mn, less than about 0.15 wt. % Fe, and less than about 250 ppm Cu, based on the equivalent mass of $Mg(OH)_2$.

21. A process according to claim 13, wherein the bleaching pulp mixture has a final pH of about 6.5 to about 8.0.

22. A process according to claim 13, wherein fresh hydrogen peroxide is added to said filtrate prior to recycle as bleaching mixture.

23. A process according to claim 13, wherein at least a portion of said filtrate and said bleaching mixture are combined prior to combining with said wood pulp.

24. A process according to claim 13, wherein the mechanical wood pulp is selected from a group consisting of stone groundwood (SGW), pressurized stone groundwood (PSGW), refiner mechanical (RMP) and thermomechanical pulp (TMP).

25. A process according to claim 13, wherein bleaching pulp mixture is formed in the absence of sodium silicate.

26. A process according to claim 13, wherein bleaching pulp mixture is formed in the absence of sodium hydroxide.

* * * * *